US011889915B2

(12) United States Patent
Ressler

(10) Patent No.: US 11,889,915 B2
(45) **Date of Patent: *Feb. 6, 2024**

(54) HAMMOCK

(71) Applicant: Dutch Clips LLC, Reinholds, PA (US)

(72) Inventor: Thomas Ressler, Reinholds, PA (US)

(73) Assignee: Dutch Clips, LLC, Reinholds, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/865,133

(22) Filed: Jul. 14, 2022

(65) Prior Publication Data

US 2022/0346533 A1 Nov. 3, 2022

Related U.S. Application Data

(63) Continuation of application No. 17/130,258, filed on Dec. 22, 2020, now Pat. No. 11,412,836, which is a continuation of application No. 15/479,758, filed on Apr. 5, 2017, now Pat. No. 10,897,982, which is a continuation of application No. 15/251,694, filed on Aug. 30, 2016, now Pat. No. 10,306,955.

(60) Provisional application No. 62/236,563, filed on Oct. 2, 2015.

(51) Int. Cl.

| | |
|---|---|
| ***A45F 3/22*** | (2006.01) |
| ***A45F 3/24*** | (2006.01) |
| ***A45C 13/10*** | (2006.01) |

(52) U.S. Cl.

CPC ..... *A45F 3/22* (2013.01); *A45C 13/103* (2013.01); *A45F 3/24* (2013.01)

(58) Field of Classification Search

CPC ..... A45F 3/52; A45F 3/22; A45F 3/24; Y10T 24/2509; Y10T 24/2593; E04H 15/04; A45C 13/103; A44B 19/382; A44B 19/28

See application file for complete search history.

(56) References Cited

U.S. PATENT DOCUMENTS

| | | | |
|---|---|---|---|
| 1,071,764 | A | 9/1913 | Lowrimore |
| 2,284,900 | A | 6/1942 | Henderson et al. |
| 2,375,792 | A | 5/1945 | Kearny |
| 3,675,256 | A | 7/1972 | Tallarico et al. |
| 3,964,113 | A | 6/1976 | Dean, II |

(Continued)

FOREIGN PATENT DOCUMENTS

| | | | |
|---|---|---|---|
| CH | 520489 | A * | 3/1971 |
| DE | 10 2014 116 104 | A1 | 5/2016 |
| GB | 2030212 | A | 4/1980 |

*Primary Examiner* — Robert Sandy
*Assistant Examiner* — Louis A Mercado
(74) *Attorney, Agent, or Firm* — Barley Snyder

(57) ABSTRACT

A hammock assembly is provided and includes a fastening system, a hammock, a first cover, and a second cover. The fastening system includes a first tape section and second tape section corresponding to the first tape section. The hammock includes a hammock body with the first tape section attached to an edge thereof. The first cover has a cover body with the second tape section attached to an edge thereof, the cover removably attachable to the hammock by connecting the first tape section and the second tape section. The second cover is a permeable netting and includes the second tape section attached to an edge thereof. The second cover convertible with first cover and removably attachable to the hammock by connecting the first tape section and the second tape section.

15 Claims, 18 Drawing Sheets

(56) References Cited

U.S. PATENT DOCUMENTS 3,977,051 A 8/1976 Takamatsu
4,001,902 A 1/1977 Hall et al.
4,057,859 A * 11/1977 Setterholm ..... E04H 15/04 5/128
4,484,362 A 11/1984 Asher
4,703,521 A 11/1987 Asher et al.
5,697,130 A 12/1997 Smith
6,185,763 B1 * 2/2001 Hennessy ..... A47G 9/086 5/120
6,347,638 B1 * 2/2002 Scott ..... E04H 15/04 135/96
6,353,946 B1 * 3/2002 Steiner ..... E04H 15/04 5/120
6,389,620 B1 * 5/2002 Hennessy ..... A45F 3/22 5/120
6,421,851 B2 * 7/2002 Hennessy ..... A45F 3/22 5/120
6,711,763 B2 * 3/2004 Batchelder ..... A45F 3/22 5/120
6,851,137 B2 * 2/2005 Hennessy ..... A45F 3/22 5/120
6,865,757 B2 * 3/2005 Hennessy ..... A45F 3/22 5/120
7,020,915 B1 * 4/2006 Helsdon ..... A45F 3/22 5/127
7,178,182 B2 2/2007 Brenner et al.
7,383,597 B2 6/2008 Steiner
7,627,913 B2 * 12/2009 Clark ..... A45F 3/22 5/120
7,699,068 B2 * 4/2010 Helsdon ..... A45F 3/22 135/96
8,087,110 B1 * 1/2012 Park ..... A47C 29/006 135/96
8,973,224 B2 3/2015 Sato
9,072,367 B2 7/2015 Kramer
2002/0142123 A1 10/2002 Yamaguchi et al.
2004/0181919 A1 9/2004 Mizuhara et al.
2004/0181920 A1 9/2004 Mizuhara et al.
2006/0290497 A1 12/2006 Sugata
2007/0137959 A1 6/2007 Zauderer
2008/0072944 A1 3/2008 Wu
2014/0196209 A1 7/2014 Macaskill
2016/0213131 A1 7/2016 Frazer et al.
2017/0224092 A1 8/2017 Smith, Jr.
2017/0358289 A1 12/2017 Israel et al.
2018/0079830 A1 3/2018 Waddy

* cited by examiner

HAMMOCK

CROSS-REFERENCE TO RELATED APPLICATIONS

This application is a continuation of U.S. patent application Ser. No. 17/130,258, filed on Dec. 22, 2020 now U.S. Patent No. 11,412,836 and U.S. patent application Ser. No. 15/479,758, filed on Apr. 5, 2017 now U.S. Pat. No. 10,897,982, which claims the benefit of U.S. Pat. No. 10306955 issued on Jun. 4, 2019 and U.S. Provisional Patent Application No. 62/236,563, filed on Oct. 2, 2015.

FIELD OF THE INVENTION

The present invention relates to a hammock, and more particularly, to a hammock having a zipper fastener system.

BACKGROUND

Known articles such as hammocks, bags and jackets use two sliders in a zipper fastener system to make for easy adjustment of the zipper fastener system. However, these known systems require specific modification along ends of the known zipper fastener system, such that the ends are tucked and secured by stitching to the article.

There is a need for a zipper fastener system having connection sections attached to independent pieces of the articles that may be secured to and removed from each other utilizing two sliders, such that, when the connection sections are secured to each other, the two sliders permit an access opening of variable length and location along the connection sections and permit adjustments from either side of the zipper fastener system.

SUMMARY

A hammock assembly is provided and includes a fastening system, a hammock, a first cover, and a second cover. The fastening system includes a first tape section and second tape section corresponding to the first tape section. The hammock includes a hammock body with the first tape section attached to an edge thereof. The first cover has a cover body with the second tape section attached to an edge thereof, the cover removably attachable to the hammock by connecting the first tape section and the second tape section. The second cover is a permeable netting and includes the second tape section attached to an edge thereof. The second cover convertible with first cover and removably attachable to the hammock by connecting the first tape section and the second tape section.

BRIEF DESCRIPTION OF THE DRAWINGS

The invention will now be described by way of example with reference to the accompanying figures of which.

DETAILED DESCRIPTION OF THE EMBODIMENT(S)

Figure 1:
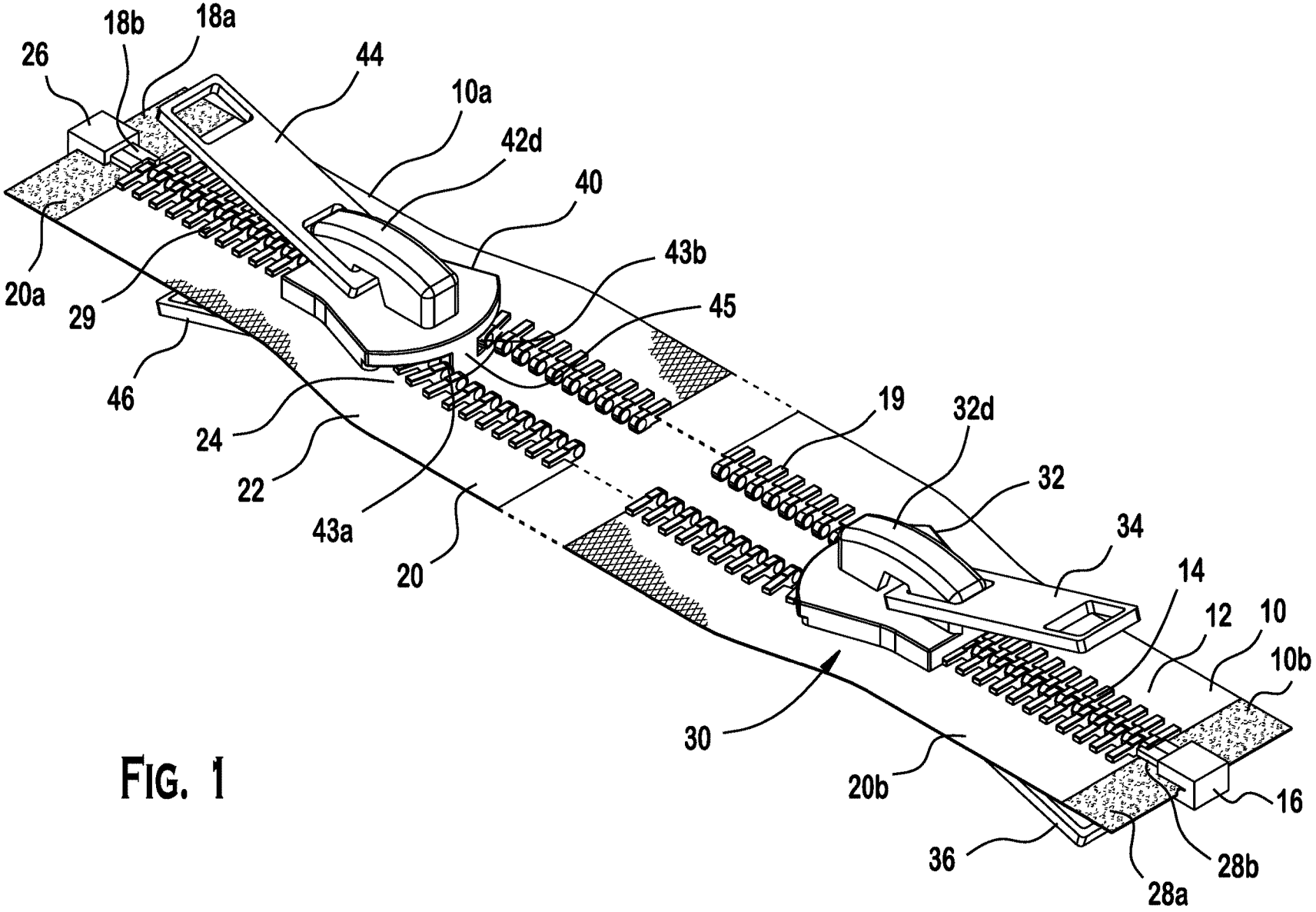
FIG. 1 is a perspective view of a zipper fastener system according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A zipper fastener system 1 according to the invention is shown in FIG. 1. Generally, the zipper fastener system 1 includes a first tape section 10, a second tape section 20, a first slider 30, and a second slider 40.

As shown in FIGS. 1-13, the first tape section 10 (having a first end and a second end) includes a first connection section 12, a first set of fastener elements 14, a first retainer box 16, and a first retainer pin 18*b*.

The first connection section 12 (having a first end 12*a* and a second end 12*b*) is a strip of tape that extends along a length thereof. The first connection section 12 can be attached to a first structure (not shown), such as a garment, textile, or other materials, using stitching, mechanical weld, or adhesive. In particular, the first connection section 12 is attached to the first structure (not shown) along a right side thereof. The second connection section 22 is attached to a second structure (not shown) along a left side thereof and is described in more detail below. Removable attachment of the first structure to the second structure is desirable or advantageous. For instance, in one embodiment of the invention, the first structure may be a sleeping bag, a hammock, or a tent. For instance, the second structure may be a second sleeping bag, a second hammock, a second tent, a net, a tarp, a travel bag, etc.

The first set of fastener elements 14 are teeth in the shown embodiment and are positioned along the length of the first connection section 12. The teeth of the first set of fastener elements 14 are positioned on a left side of the first connection section 12 and are generally parallel to each other. The teeth of the first set of fastener elements 14 extend away from the first connection section 12, substantially perpendicular to the length of the first connection section 12.

Figure 4:
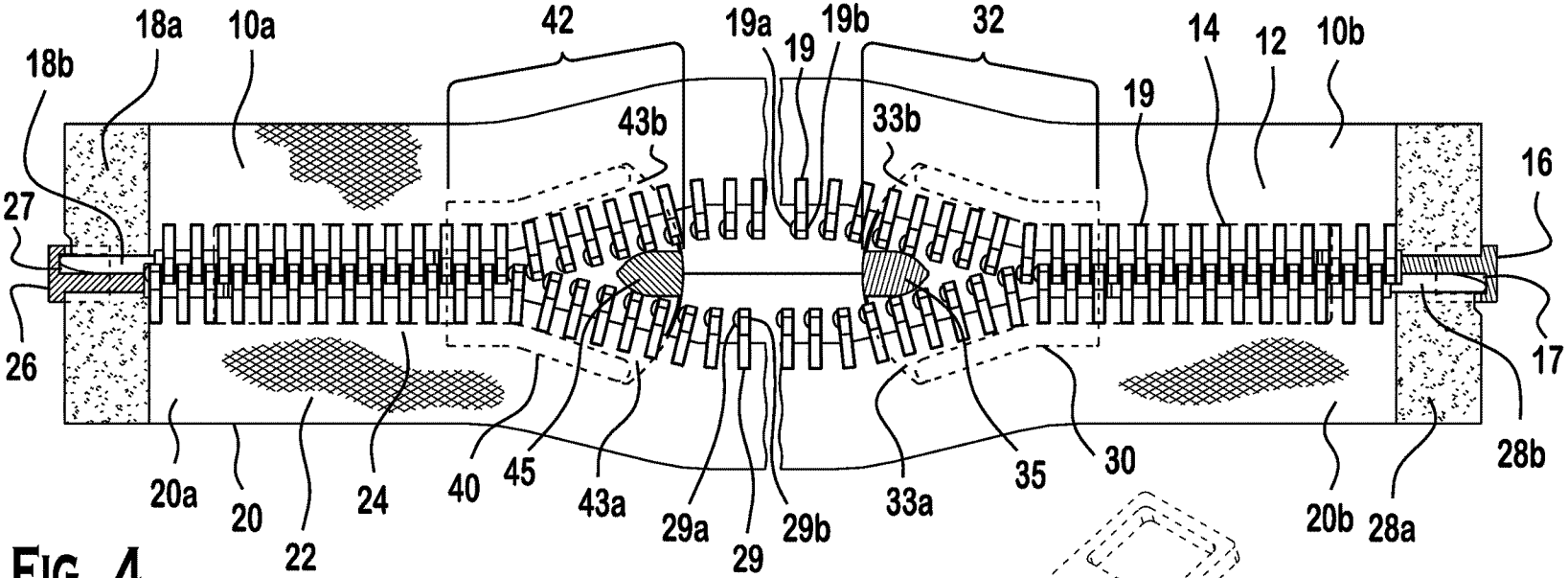
FIG. 4 is a top view of the zipper fastener system of FIG. 3 along line 4-4.
Figure 5:
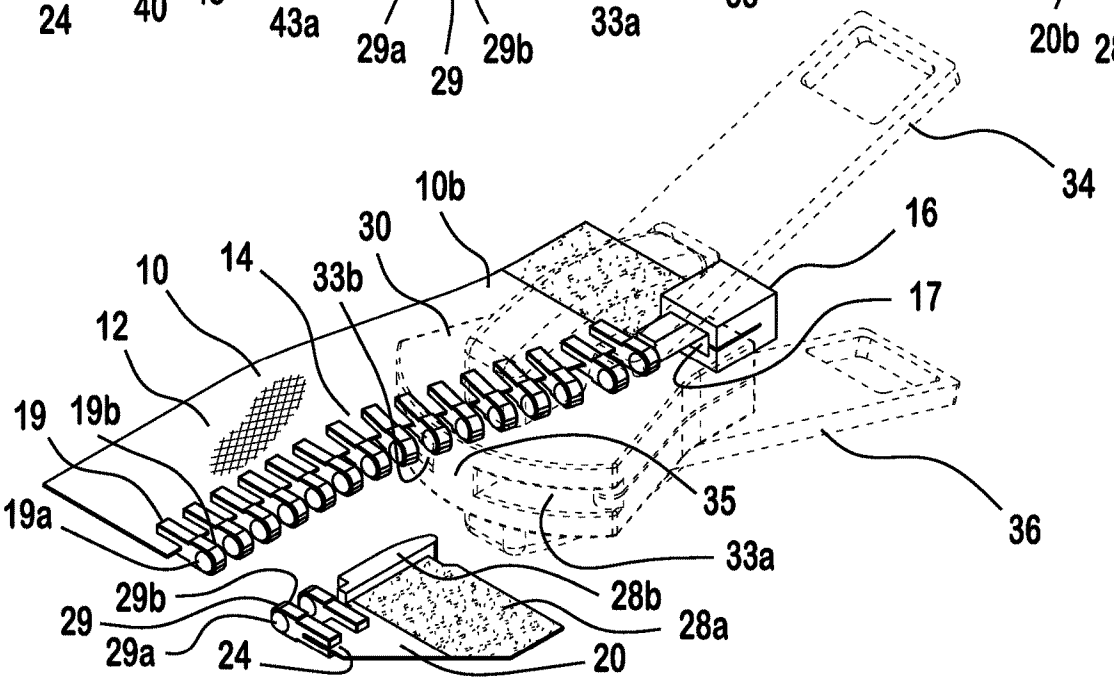
FIG. 5 is a close up perspective view of the zipper fastener system according to the invention showing connection between first and second tape sections.
Figure 13:
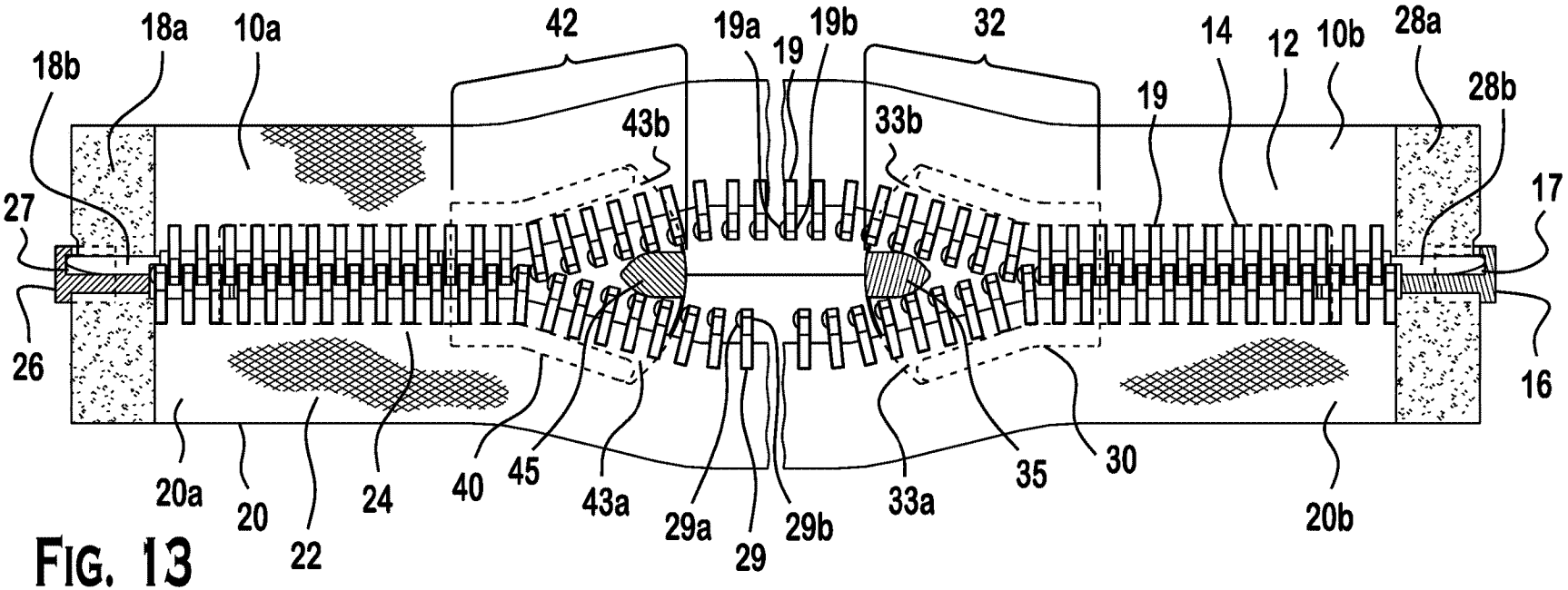
FIG. 13 is a bottom view of the zipper fastener system of FIG. 9.

The fastener elements 14 of the zippers are of various types including those of nylon coil, or plastic, metal, or nylon teeth 19, 29. It is understood that "teeth" or "coil" are used interchangeably herein. The teeth collectively form a connection (zipper track). Each tooth 19, 29 includes a hollow 19*a*, 29*a* on one face and a hook 19*b*, 29*b* on the opposite face. Each zipper fastener system 1 includes two connection sections (or zipper tracks) of teeth which are latched together by operation of the sliders 30, 40. The sliders 30, 40 are independently moved along the two zipper tracks of uniformly sized and shaped teeth 19, 29. Wedge-shaped walls 35, 45 internal to the sliders 30, 40 respectively direct the two zipper tracks of teeth 19, 29 at an angle and into an interlocking relationship with each other. The zipper tracks are offset so that, in sequence, as the slider 30, 40 is drawn along the zipper tracks, a hollow 19*a* of one tooth on one zipper track aligns with a hook 29*b* of the tooth on the other zipper track as shown in FIGS. 4 and 13. The size of the zipper teeth is on the basis of the use to which the zipper fastener system will be subjected. Use of the zipper fastener system in camping equipment suggests a lightweight #3 gauge nylon coil zipper with a polyester tape and teeth that are water-, abrasion-, and UV-resistant and sliders made of molded plastic or metal, but one of ordinary skill in the art can select the particular material specifications to suit particular conditions.

As shown in FIGS. 4-8, the first retainer box 16 is a box structure having a first retainer pin receiving cavity 17. The first retainer pin receiving cavity 17 is sized and shaped to correspond with the second tape section 20 and, more particularly, to receive a second retainer pin 28*b* thereof (which will be described in more detail below). The first retainer box 16 may include a magnet to facilitate assembly with the second tape section 20. As shown in a first embodiment, the first retainer box 16 is attached to a lower end 10*b* of first connection section 12. It is attached so as to prevent its separation from the first connection section 12.

As shown in FIGS. 4-8, the first retainer pin 18*b* includes a first grip member 18*a* positioned adjacent to the first retainer pin 18*b*. The first retainer pin 18*b* is an elongated box shaped member that is generally rigid and dimensioned for insertion into the second slider 40 and the second tape section 20 and, more particularly, for insertion into a second retainer box 26 (which will be described in more detail below). A first tooth member 19 may be provided at the top of the first retainer pin 18*b*. As shown, the first retainer pin 18*b* is attached to an upper end 10*a* of first connection section 12. It is attached so as to prevent separation from the first connection section 12.

Figure 6:
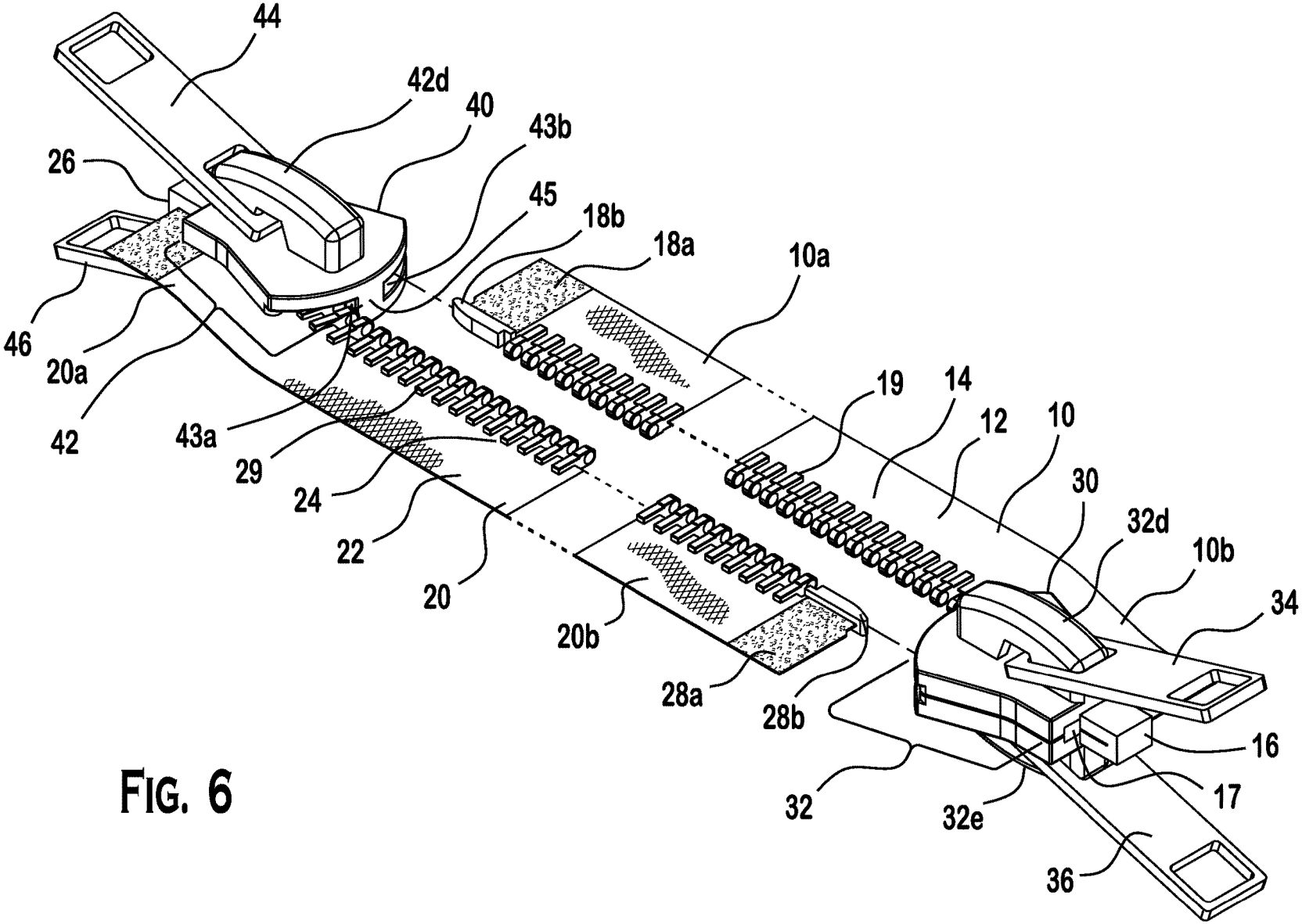
FIG. 6 is another perspective view of the zipper fastener system according to the invention before the first and second tape sections are connected.
Figure 7:
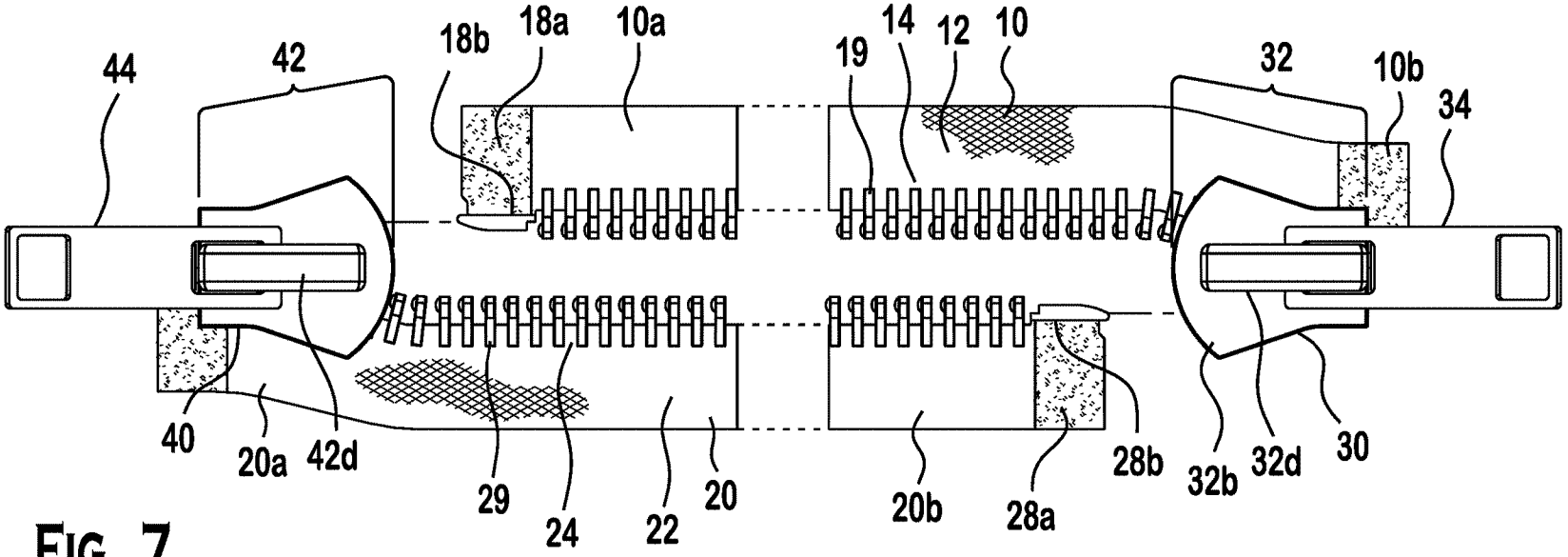
FIG. 7 is a top view of the zipper fastener system of FIG. 6.
Figure 8:
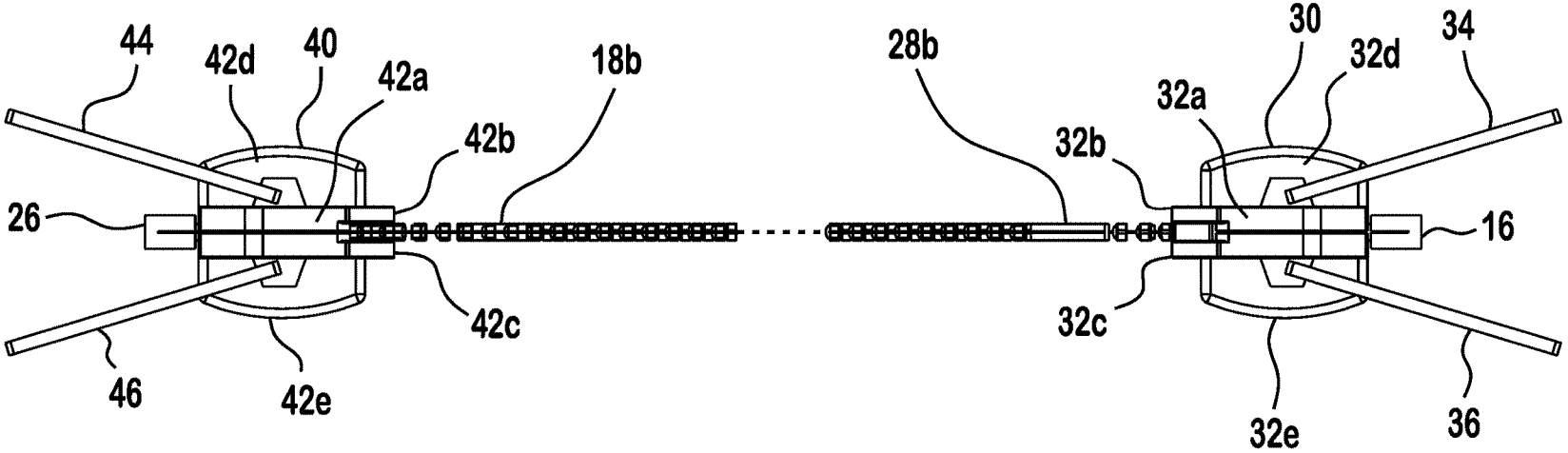
FIG. 8 is a side view of the zipper fastener system of FIG. 6.

As shown in FIGS. 6-8, the second tape section 20 (having a first end and a second end) includes a second connection section 22, a second set of fastener elements 24, the second retainer box 26, and a second retainer pin 28*b*.

The second connection section 22 (having a first end 22*a* and a second end 22*b*) is a strip of tape that extends along a length thereof. The second connection section 22 can be attached to a second structure (not shown), such as a garment, textile, or other materials, using stitching, mechanical weld, or adhesive. In particular, the second connection section 22 is attached to the second structure (not shown) along a left side thereof. The second structure is separate from the first structure. Removable attachment of the first structure to the second structure is desirable or advantageous. For instance, in one embodiment of the invention, the first structure may be a sleeping bag, a hammock, or a tent. For instance, the second structure may be a second sleeping bag, a second hammock, a second tent, a net, a tarp, a travel bag, etc.

The second set of fastener elements 24 are teeth in the shown first embodiment and are positioned along the length of the second connection section 22. The teeth of the second set of fastener elements 24 are positioned on a right side of the second connection section 22 and are generally parallel to each other. The teeth of the second set of fastener elements 24 extend away from the second connection section 22, substantially perpendicular to the length of the second connection section 22.

As shown in FIGS. 1-8, the second retainer box 26 is a box structure having a second retainer pin receiving cavity 27. The second retainer pin receiving cavity 27 is sized and shaped to correspond with the second tape section 20 and, more particularly, to receive a first retainer pin 28*b* thereof. The second retainer box 26 may include a magnet to facilitate assembly with the second tape section 20. As shown, the second retainer box 26 is attached to an upper end 20*a* of the second connection section 22. It is attached so as to prevent separation from the second connection section 22.

As shown in FIGS. 1-8, the second retainer pin 28*b* includes a second grip member 28*a* positioned adjacent to the second retainer pin 28*a*. The second retainer pin 28*b* is an elongated box shaped member that is generally rigid and dimensioned for insertion into the first slider 30 and the first tape section 10 and, more particularly, for insertion into the first retainer box 16. A second tooth member 29 may be provided at the top of the second retainer pin 28*b*. As shown, the second retainer pin 28*b* is attached to a lower end 20*b* of second connection section 22. It is attached so as to prevent separation from the second connection section 22.

Now with reference to FIGS. 9-13, another embodiment of the invention is described wherein the first and second retainer pins 18*b*, 28*b* are located at opposite ends of the same tape section (10 or 20 respectively) and the first and second retainer boxes 16, 26 are located at opposite ends of the remaining tape section. More particularly, the first retainer pin 18*b* and the second retainer pin 28*b* are attached to opposite ends of the same tape section. In the shown embodiment, one of the tape sections 10 or 20 includes both the first retainer pin 18*b* with a first grip member 18*a* and the second retainer pin 28*b* and second grip member 28*a* attached to opposite ends (i.e., to the lower end 10*b* and the upper end 10*a* of the first connection section 12 or to the upper end 20*a* and the lower end 20*b* of the second tape section 20). In such an embodiment, the remaining tape section that does not include first retainer pin 18*b* with first grip member 18*a* and the second retainer pin 28*b* and second grip member 28*a* instead includes both the first retainer box 16 having a first retainer pin receiving cavity 17 and the second retainer box 26 having a second retainer pin receiving cavity 27 attached to opposite ends (i.e., to the lower end and the upper end) of the remaining tape section. These are attached so as to prevent separation from the respective connection section 12. 22.

Now with reference to the FIGS. 1-13, the first slider 30 will be described. The first slider 30 includes a first slider body 32, a first outer pull tab 34, and a first inner pull tab 36.

The first slider body 32 includes a first main body 32*a*, a first upper arm 32*b*, a first lower arm 32*c*, a first outer tab connector 32*d*, and a first inner tab connector 32*e*. The first main body 32*a* is a vertical wall running a length thereof. The first upper arm 32*b* and the first lower arm 32*c* are wings that protrude laterally from the first slider body 32 with the first main body 32*a* running vertically with respect to the first upper arm 32*b* and the first lower arm 32*c*. As a result, the first main body 32*a* divides a receiving space between facing surfaces of the first upper arm 32*b* and the first lower arm 32*c*. As a result, the first slider body 32 includes a first fastener element receiving passageway 33*a* running along the length of one side of the first slider body 32. A second fastener element receiving passageway 33*b* is also provided and runs along the length of another side of the first slider body 32, which is opposite the first fastener element receiving passageway 33*a*. The first outer tab connector 32*d* is a looped structure for fastening or connecting the first outer pull tab 34. The first outer tab connector 32*d* is positioned on the outer wall of the first upper arm 32*b*. Likewise, the first inner tab connector 32*e* is also a looped structure for fastening or connecting the first inner pull tab 36. The first inner tab connector 32*e* is positioned on the outer wall of the first lower arm 32*c*. The first outer pull tab 34 and the first inner pull tab 36 are connected and movable with the first outer tab connector 32*d* and the first inner tab connector 32*e*, respectively.

In the shown embodiment, the first slider 30 is movably positioned adjacent to first retainer box 16 and is mounted on the first tape section 10, although it is free to move along the length thereof except as described below with reference to the second slider 40.

Now with reference to the FIGS. 1-13, the second slider 40 will be described. The second slider 40 includes a second slider body 42, a second outer pull tab 44, and a second inner pull tab 46.

The second slider body 42 includes a second main body 42*a*, a second upper arm 42*b*, a second lower arm 42*c*, a second outer tab connector 42*d*, and a second inner tab connector 42*e*. The second main body 42*a* is a vertical wall running a length thereof. The second upper arm 42*b* and the second lower arm 42*c* are wings that protrude laterally from the second slider body 42 with the second main body 42*a* running vertically with respect to the second upper arm 42*b* and the second lower arm 42*c*. As a result, the second main body 42*a* divides a receiving space between facing surfaces of the second upper arm 42*b* and the second lower arm 42*c*. As a result, the second slider body 42 includes a second fastener element receiving passageway 43*a* running along the length of one side of the second slider body 42. A first fastener element receiving passageway 43*b* is also provided and runs along the length of another side of the second slider body 42, which is opposite the second fastener element receiving passageway 43*a*.

The second outer tab connector 42*d* is a looped structure for fastening or connecting the second outer pull tab 44. The second outer tab connector 42*d* is positioned on the outer wall of the second upper arm 42*b*. Likewise, the second inner tab connector 42*e* is also looped structure for fastening or connecting the second inner pull tab 46. The second inner tab connector 42*e* is positioned on the outer wall of the second lower arm 42*c*. The second outer pull tab 44 and the second inner pull tab 46 are connected and movable with the second outer tab connector 42*d* and the second inner tab connector 42*e*, respectively.

In the shown first embodiment of FIGS. 6-8, the second slider 40 is movably attached adjacent to the second retainer box 26 and is mounted on the second tape section 20, although it is free to move along the length thereof.

Now with reference to FIGS. 9-13, another embodiment of the invention is described wherein the first and second sliders 30, 40 are movably attached adjacent to first and second retainer boxes 16, 26 respectively and located at opposite ends of the same tape section (10 or 20). First and second sliders 30, 40 are mounted on the same tape section, although each slider is free to move along the length thereof to the point of meeting the remaining slider. They are mounted so as to prevent separation from the connection section on which they are mounted.

More particularly in such another embodiment, the first slider 30 and the second slider 40 are mounted on the same tape section. The first slider 30 is movably attached adjacent to the first retainer box 16 and either the first retainer pin 18*b* or the second retainer pin 28*b* is positioned through first slider 30 and into the first retainer box 16. Likewise, in this embodiment, the second slider 40 is movably attached adjacent to the second retainer box 26 and the remaining retainer pin (either 28*b* or 18*b* respectively) is positioned through second slider 40 and into the second retainer box 26. They are mounted so as to prevent separation from the tape section.

Now with reference to the Figures, assembly and use of the zipper fastener system 1 according to the shown embodiments of the invention will be described.

The first connection section 12 is attached to a first structure (not shown), while the second connection section 22 is attached to a second structure (not shown).

In the first shown embodiment, in FIGS. 1-8, the first slider 30 is movably attached to first retainer box 16 and the second retainer pin 28*b* is positioned through first slider 30 and into the first retainer box 16. Likewise, in the shown first embodiment, the second slider 40 is movably attached to the second retainer box 26 and the first retainer pin 18*b* is positioned through second slider 40 and into the second retainer box 26.

The first slider 30 moves along the first tape section 10 such that the first set of fastener elements 14 engages and connects with the second set of fastener elements 24. Likewise, the second slider 40 moves along the second tape section 20 such that the second set of fastener elements 24 engages and connects with the first set of fastener elements 14. Accordingly, the first tape section 10 and second tape section 20 can be connected together and secured, or can be removed and separated from each other.

Likewise, in other shown embodiment, FIGS. 8-13, wherein the first and second retainer pins 18, 28 are located at opposite ends of the same tape section, 10 or 20, respectively, the first slider 30 is movably placed adjacent to the first retainer box 16 and the second retainer pin 28*b* is positioned through first slider 30 and into the first retainer box 16. As well, in this shown embodiment, the second slider 40 is movably placed adjacent to the second retainer box 26 and the first retainer pin 18*b* is positioned through second slider 40 and into the second retainer box 26.

After the first retainer pin 18*b* is positioned into the first retainer box 16 as described above, the first slider 30 moves along the first tape section 10 such that the first set of fastener elements 14 engages and connects with the second set of fastener elements 24. Likewise, after the second retainer pin 28*b* is positioned into the second retainer box 26 as described above, the second slider 40 moves along the first tape section 10 such that the second set of fastener elements 24 engages and connects with the first set of fastener elements 14. The first slider and second slider are independently moved by means of the inner or outer pull tabs along the first and second tape sections. Accordingly, the first tape section 10 and second tape section 20 can be connected together and secured, or can be removed and separated from each other.

Regardless of whether invention is operated having the first and second retainer pins 18*b*, 28*b* and the corresponding first and second retainer box 16, 26 located on the same tape sections, or in the alternative, wherein the first and second retainer pins 18*b*, 28*b* and the corresponding first and second retainer box 16, 26 are located on different tape sections, the first slider 30 and the second slider 40 can be movably positioned to engage and connect the first set of fastener elements 14 with the second set of fastener elements 24. The first slider 30 and the second slider 40 may be so positioned on first tape section 10 and second tape section 20 such that, as between the first set of fastener elements 14 and the second set of fastener elements 24, there is a passageway which can be varied in length in position along the first and second tape sections 10, 20. Alternatively, the first slider 30 and the second slider 40 may be so positioned adjacent to each other along the first and second tape sections 10, 20 such that there is no open passageway. The inner and outer pulls allow positioning of the sliders independently along the first and second tape sections as desired by the user from either outside the joined first and second structures or from within the joined first and second structures.

A hammock 100 and cover 200 having the zipper fastener system 1 according to the invention will now be described in greater detail with reference to FIGS. 14-23.

Figure 14:
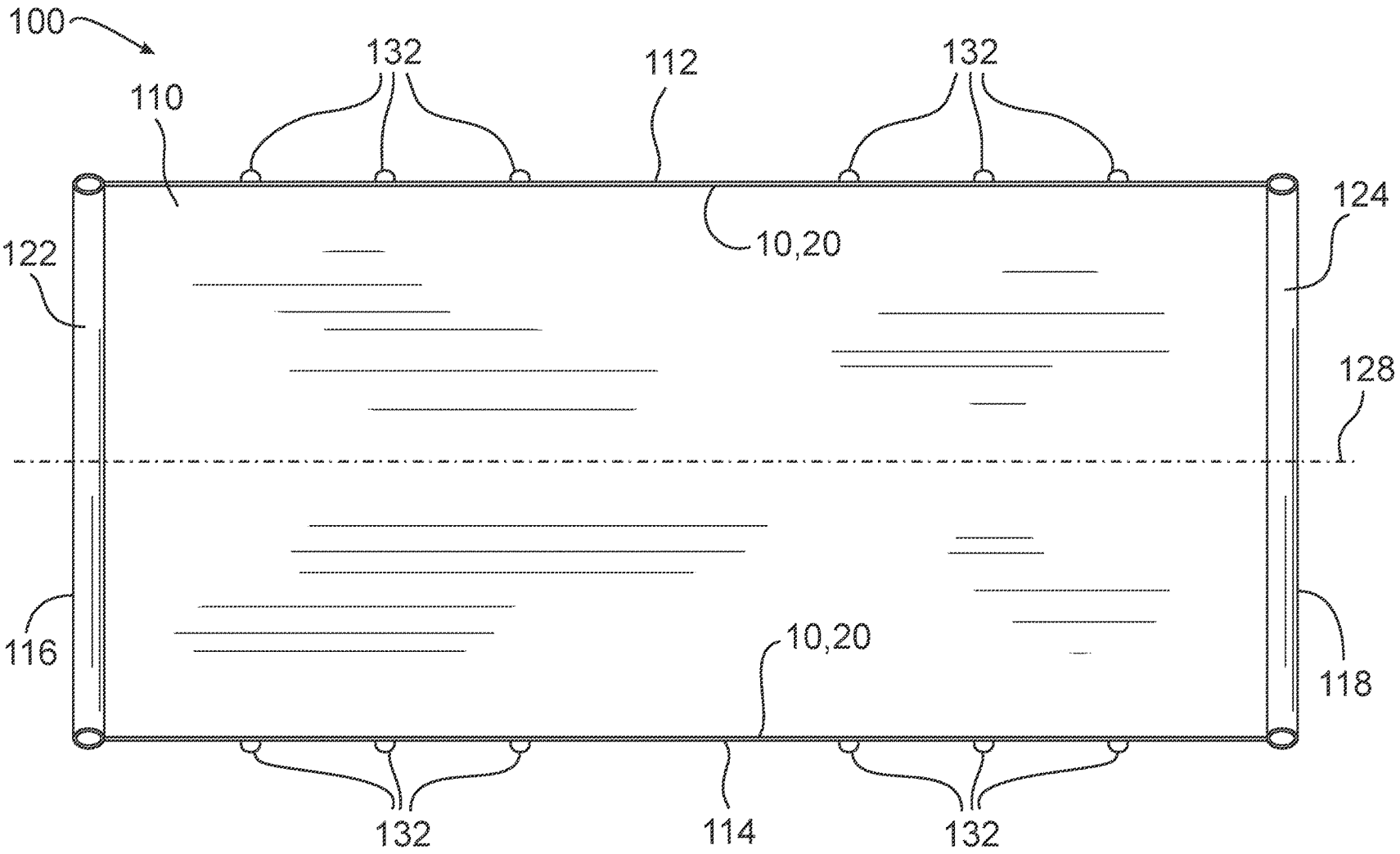
FIG. 14 is a plan view of a hammock body of a hammock according to the invention.
Figure 15:
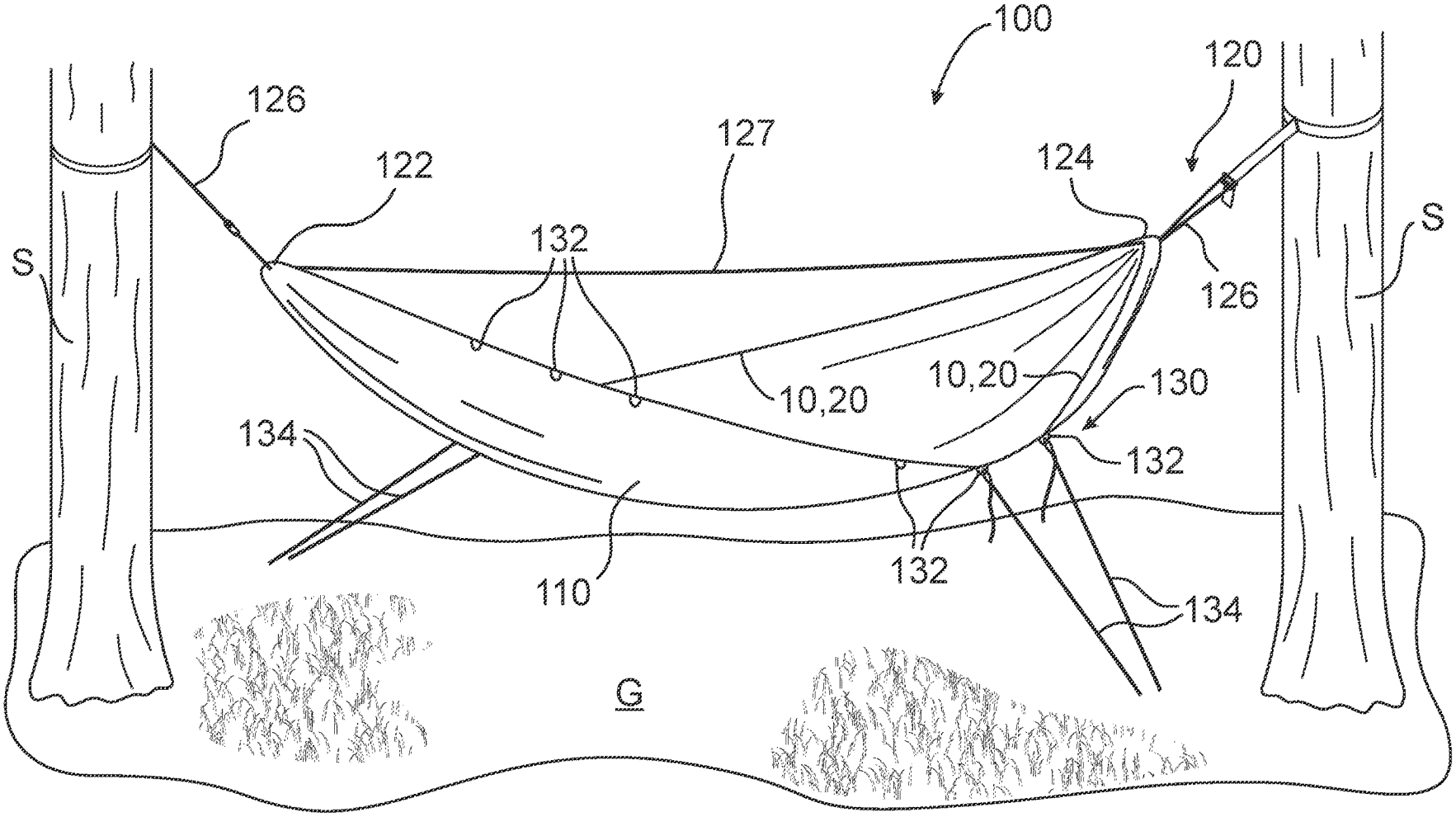
FIG. 15 is a perspective view of the hammock of FIG. 14.

The hammock 100, shown generally in FIGS. 14 and 15, includes a hammock body 110, a suspension system 120, and a tension system 130.

The hammock body 110, as shown in FIG. 14, has a first long edge 112, an opposite second long edge 114, a first short edge 116, and an opposite second short edge 118. In the shown embodiment, the hammock body 110 is formed in a rectangular shape. The hammock body 110 may be formed of nylon, cotton, silk, polyester, polypropylene, polyethylene, polytetrafluoroethylene, or other lightweight, durable fabrics, and may be reinforced with a ripstop pattern such as a HEXON ripstop grid.

As shown in FIG. 14, the first tape section 10 or the second tape section 20 of the zipper fastener system 1 is disposed along each of the first long edge 112 and the second long edge 114. In various embodiments, the first tape section 10 may be disposed along each of the first long edge 112 and the second long edge 114, the second tape section 20 may be disposed along each of the first long edge 112 and the second long edge 114, or any combination thereof. The tape sections 10, 20 may be attached to the long edges 112, 114 by sewing, gluing, welding or any other means of attachment known to those with ordinary skill in the art. As described above and shown in the embodiments of FIGS. 6 and 9, the tape sections 10, 20 disposed on each of the first long edge 112 and the second long edge 114 may each have zero sliders 30, 40, one slider 30, 40, or two sliders 30, 40.

The suspension system 120, as shown in FIGS. 14 and 15, includes a first sleeve 122, a second sleeve 124, a plurality of suspension devices 126, and a central suspension 127.

As shown in FIG. 14, the first sleeve 122 is disposed at the first short edge 116 and the second sleeve 124 is disposed at the second short edge 118. In the shown embodiment, the first sleeve 122 and the second sleeve 124 are both formed by folding over a section of the hammock body 110 and securing a free end of the hammock body 110 to the remainder of the body 110, such as by sewing, gluing or other means of attachment known to those with ordinary skill in the art. The sleeves 122, 124 thus form an extended receiving passageway across the short edges 116, 118 and have an opening at each end of the sleeve 122, 124.

The suspension devices 126, as shown in FIG. 15, each attach to one of the sleeves 122, 124. In the shown embodiment, the suspension devices 126 are ropes formed of nylon, polypropylene, polyethylene, ultra-high-molecular-weight polyethylene, or any other lightweight, durable material known in the art.

The central suspension line 127, as shown in FIG. 15, is attached between the suspension devices 126. In the shown embodiment, the central suspension line 127 is a cord formed from nylon, polypropylene, polyethylene, ultra-high-molecular-weight polyethylene, or any other lightweight, durable material known in the art.

The tension system 130, as shown in FIGS. 14 and 15, includes a plurality of tension connectors 132 and a plurality of tension devices 134.

The tension connectors 132 are disposed along both the first long edge 112 and the second long edge 114. The tension connectors 132 are disposed along the long edges 112, 114 in symmetrical groups; in the shown embodiment, two groups of three tension connectors 132 are disposed on each long edge 112, 114 opposite another group of three tension connectors 132 on the opposing long edge 112, 114. Along each long edge 112, 114, one group of tension connectors 132 is disposed adjacent the first short edge 116 and one group of tension connectors 132 is disposed adjacent the second short edge 118. One with ordinary skill in the art would understand that the total number of tension connectors 132, the number of groups of tension connectors 132 along each long edge 112, 114, the number of tension connectors 132 in each group, and the positioning of the tension connectors 132 may vary in various embodiments. In the shown embodiment, the tension connectors 132 are D-rings. One with ordinary skill in the art would understand that the tension connectors 132 may alternatively be grommets, fabric loops, or other connectors capable of attaching to a rope or cord, and known to those with ordinary skill in the art.

The tension devices 134, as shown in FIG. 15, are attached to the tension connectors 132. In the shown embodiment, the tension devices 134 are cords formed from nylon, polypropylene, polyethylene, ultra-high-molecular-weight polyethylene, or any other lightweight, durable material known in the art.

The use of the hammock 100 will now be described in greater detail with reference to FIGS. 15-19.

One suspension device 126 is passed through the first sleeve 122 at the first short edge 116 and another suspension device 126 is passed through the second sleeve 124 at the second short edge 118. The sleeves 122, 124 are gathered along the respective suspension devices 126. Each suspension device 126 is then attached to one support S as shown in FIG. 15, which may be a tree, a pole, or any other upright structure, and suspends the hammock body 110 above the ground G by tension between the supports S. One with ordinary skill in the art would understand that additional elements could be used with the suspension system 120 to secure the suspension devices 126 to the supports S, such as known webbing, paracord, fasteners, and clips. When suspended, the suspension system 120 creates a suspension axis 128 extending along the longitudinal axis of the hammock body 110, as shown in FIGS. 14 and 16-19.

The central suspension line 127, as shown in FIGS. 15-19, is connected between the suspension devices 126 extending through each of the first sleeve 122 and the second sleeve 124. The central suspension line 127 is in tension between the suspension devices 126 and extends along the suspension axis 128.

Figure 16:
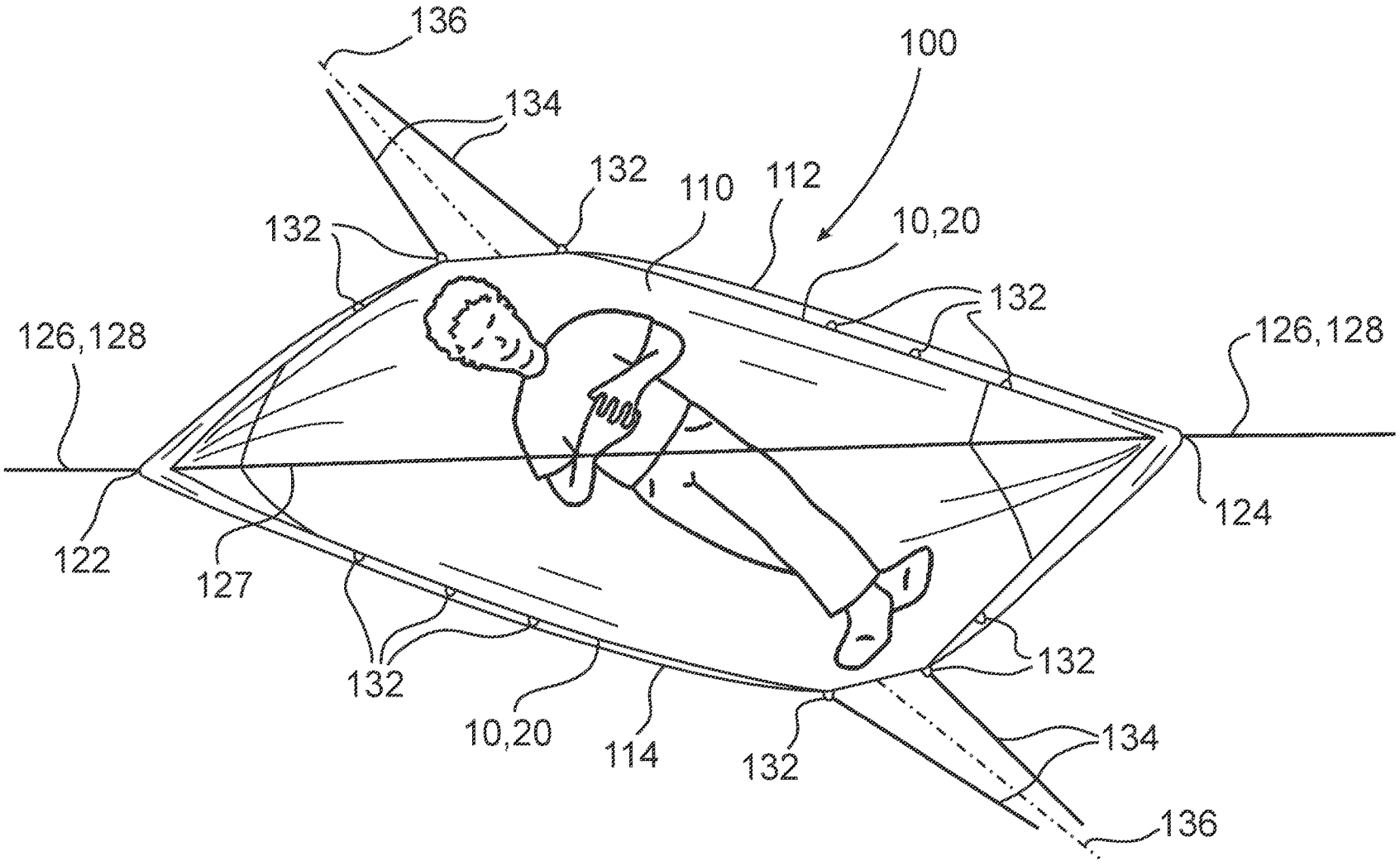
FIG. 16 is a top view of the hammock of FIG. 14 in a first orientation.
Figure 17:
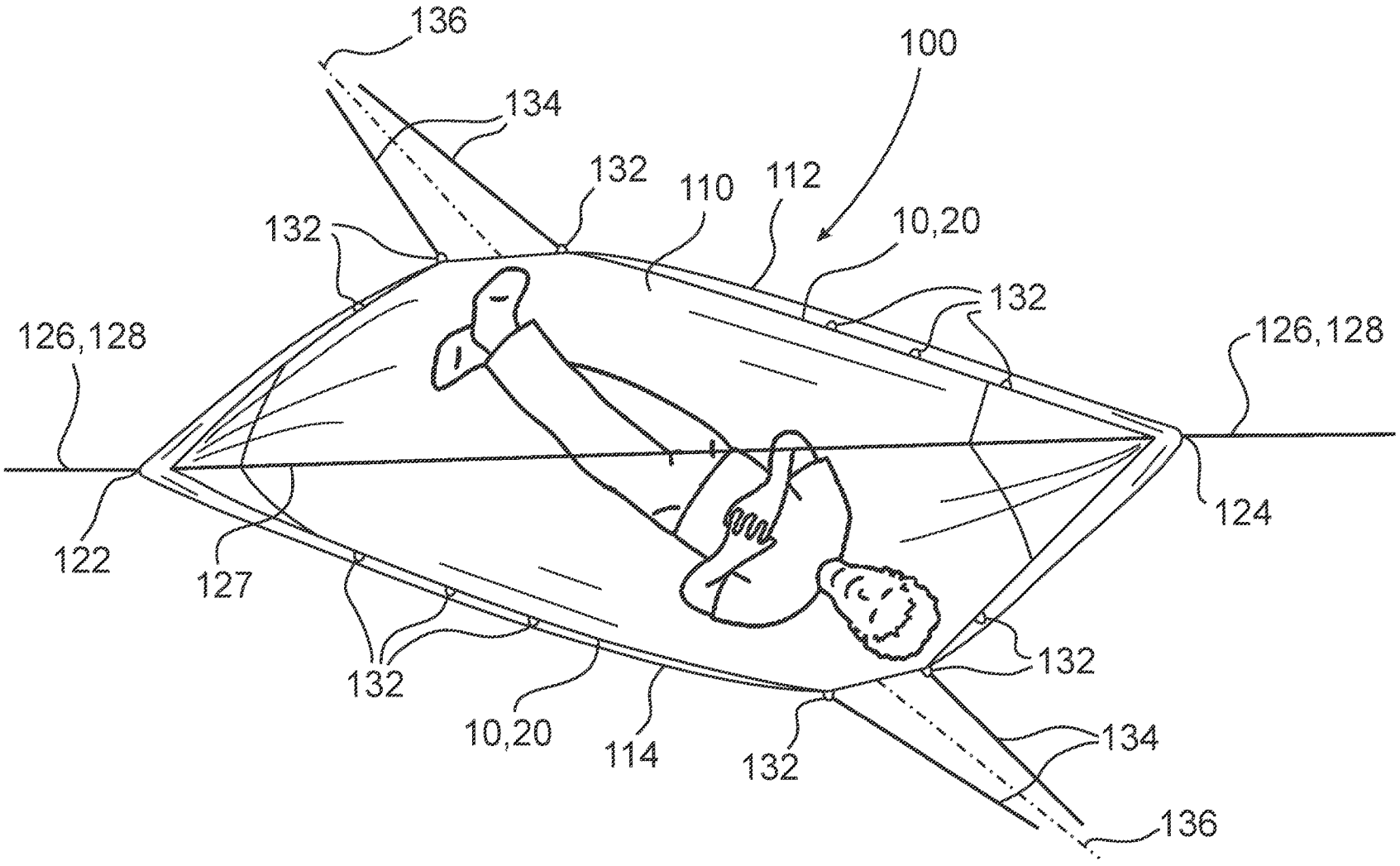
FIG. 17 is another top view of the hammock of FIG. 14 in the first orientation.

The tension system 130 is used to further shape the suspended hammock body 110 to enable a user to lay in a flatter diagonal orientation within the hammock 100. As shown in FIGS. 15-17, the tension devices 134 are attached to a subset of the tension connectors 132. Each tension device 134 is attached at a first end to one tension connector 132. The second end of each tension device 134 is attached to the ground G at such a distance to tension and hold the corresponding attached tension connector 132 at a distance further from the suspension axis 128 than the tension connectors 132 un-attached to the plurality of tension devices 134. The tension devices 134 are removably attached to the tension connectors 132, such as by a clip, a hook, a tie, or other forms of removable fastening known to those with ordinary skill in the art.

On each of the first long edge 112 and the second long edge 114, the tension devices 134 are attached to part or all of one group of tension connectors 132. As shown in FIGS. 15-19, the tension devices 134 at the first long edge 112 are attached to a group of tension connectors 132 adjacent the first sleeve 122 while the tension devices at the second long edge 114 are attached to a group of tension connectors 132 adjacent the second sleeve 124. The tension devices 134 on opposite long edges 112, 114 are attached to groups of tension connectors 132 at opposite ends to create an extended diagonal portion of the hammock body 110, forming a tension axis 136 shown in FIGS. 16-19 extending at an angle with respect to the suspension axis 128. As shown in FIGS. 16-19, a user may thus lay flat in a diagonal orientation within the hammock 100.

Figure 18:
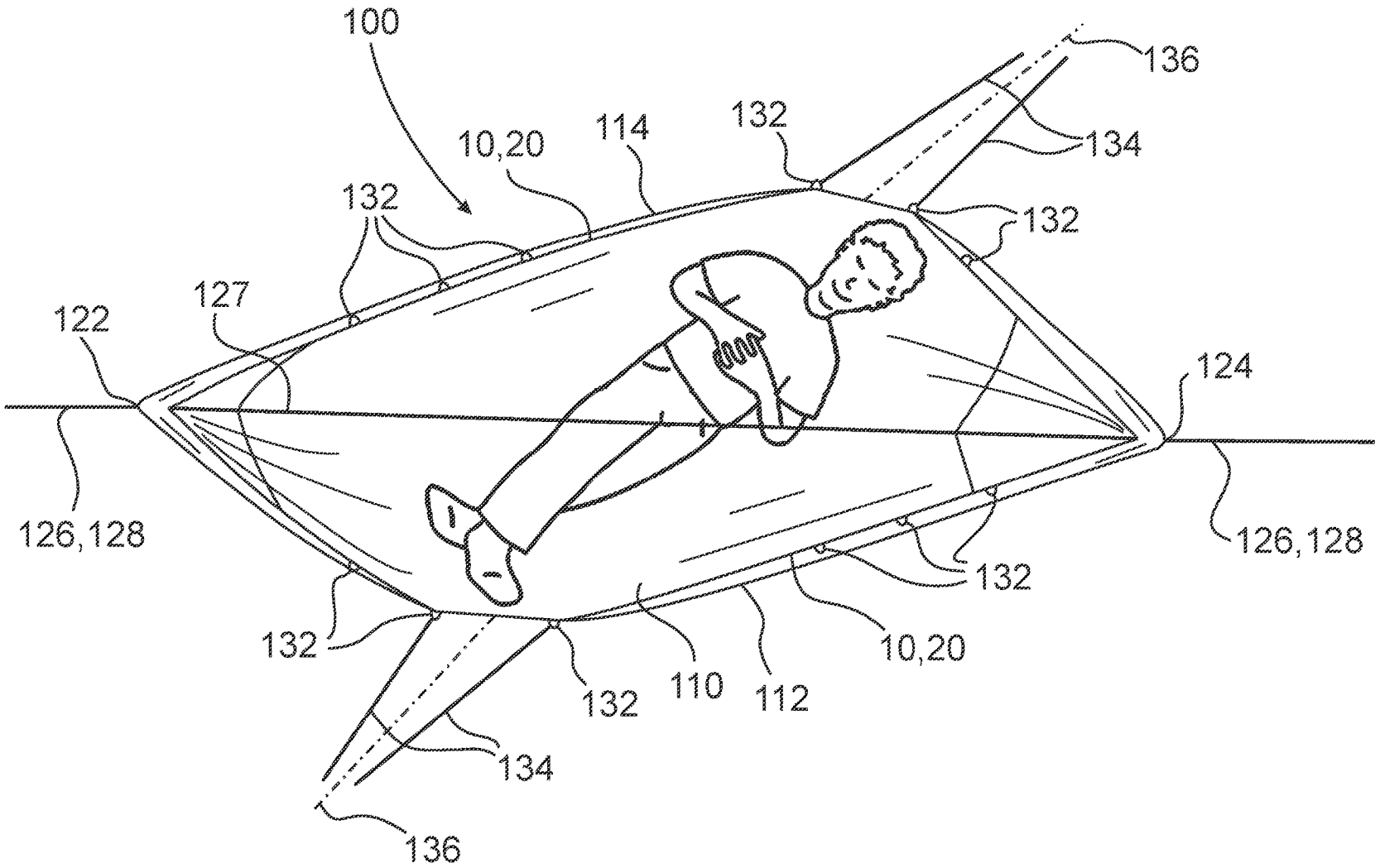
FIG. 18 is a top view of the hammock of FIG. 14 in a second orientation.
Figure 19:
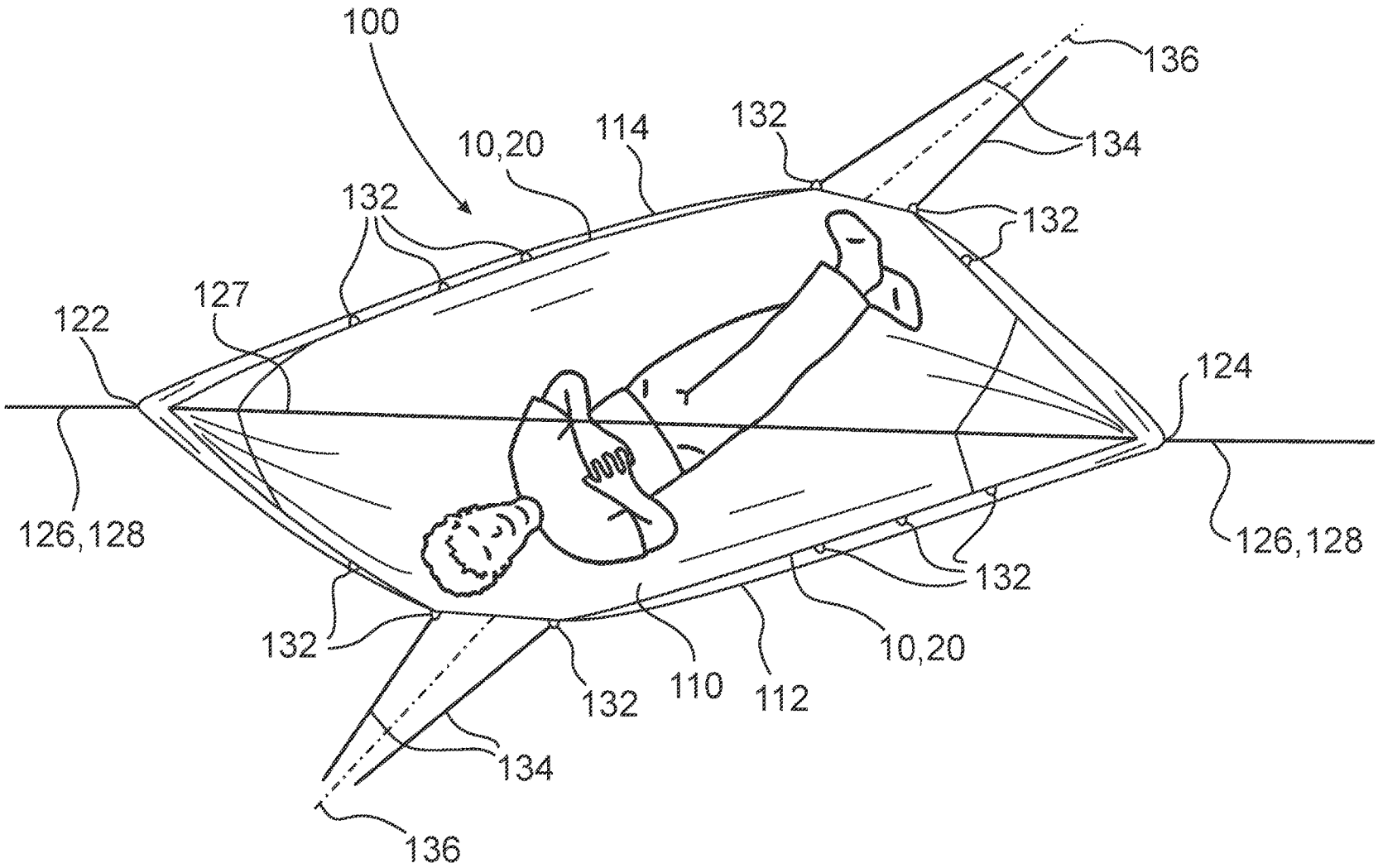
FIG. 19 is another top view of the hammock of FIG. 14 in the second orientation.

As shown in FIGS. 15-19, the tension system 130 may be used interchangeably in various configurations to enable different diagonal laying orientations. In FIGS. 15-17, the tension devices 134 are attached to and tension a first set of tension connectors 132, forming the tension axis 136 at a first angle with respect to the suspension axis 128. In this orientation of the hammock 100, a user may lay in either a first position shown in FIG. 16 or a second position shown in FIG. 17. In FIGS. 18 and 19, the tension devices 134 are attached to and tension a second set of tension connectors 132, forming the tension axis 136 at a second angle with respect to the suspension axis 128. In this orientation of the hammock 100, a user may lay in either a third position shown in FIG. 18 or a fourth position shown in FIG. 19.

Figure 20:
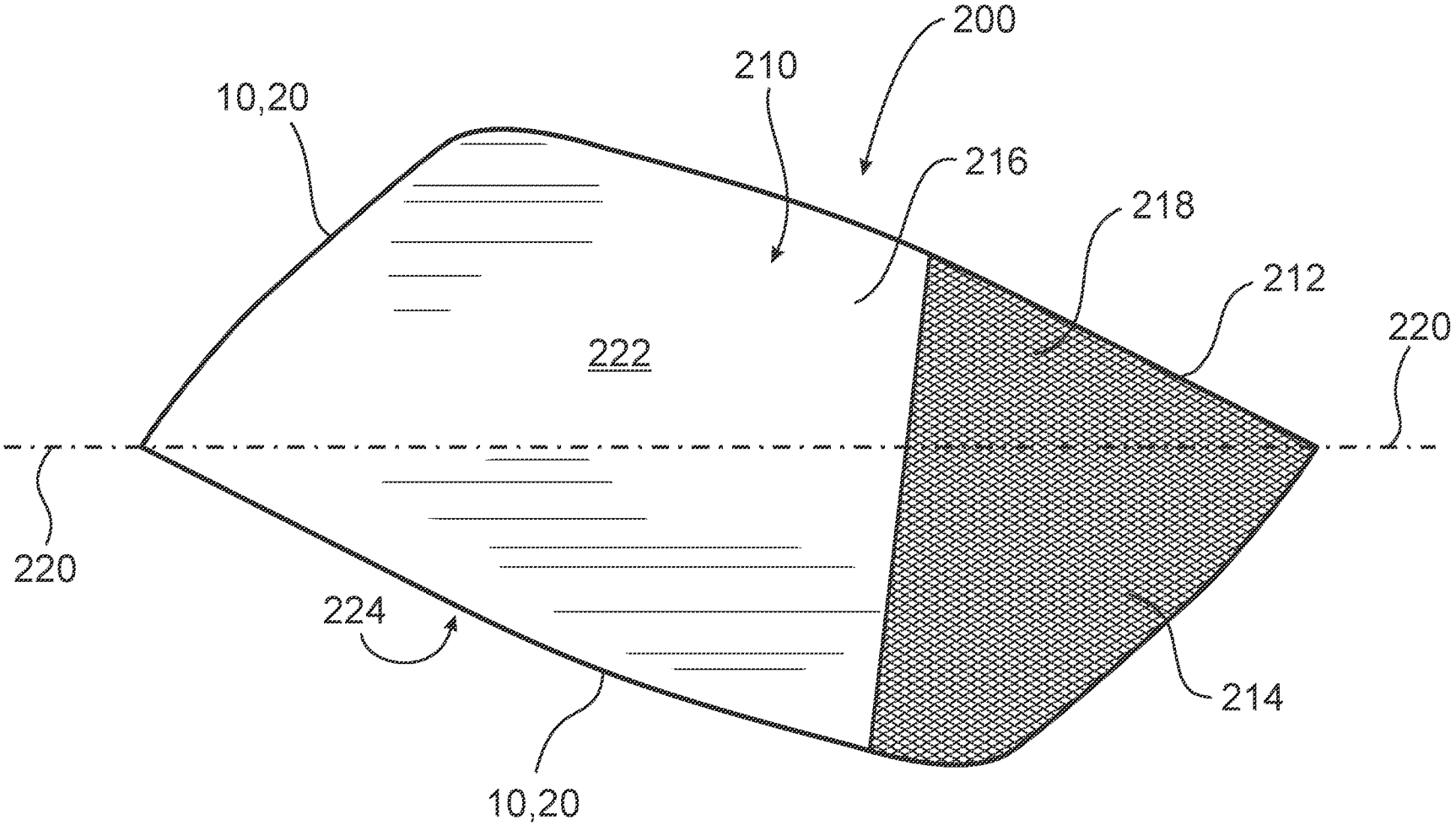
FIG. 20 is a plan view of a cover body of a cover according to the invention.

The cover 200, shown generally in FIG. 20, includes a cover body 210 having a first edge 212 and an opposite second edge 214 and is formed of a first material 216 and a second material 218.

Each of the first edge 212 and the second edge 214 has a curved shape as shown in FIG. 20 to match the hammock. The first edge 212 and the second edge 214 extend further from a cover longitudinal axis 220 at opposite longitudinal ends of the cover 200 to form a shape of the cover body 210 corresponding to the shape of the suspended and diagonally tensioned hammock 100 shown in FIG. 15.

As shown in FIG. 20, the first tape section 10 or the second tape section 20 of the zipper fastener system 1 is disposed along each of the first edge 212 and the second edge 214. In various embodiments, the first tape section 10 may be disposed along each of the first edge 212 and the second edge 214, the second tape section 20 may be disposed along each of the first edge 212 and the second edge 214, or any combination thereof. The tape sections 10, 20 may be attached to the edges 212, 214 by sewing, gluing, welding or any other means of attachment known to those with ordinary skill in the art. As described above and shown in the embodiments of FIGS. 6 and 9, the tape sections 10, 20 disposed on each of the first edge 212 and the second edge 214 may each have zero sliders 30, 40, one slider 30, 40, or two sliders 30, 40.

The first material 216 may be formed of nylon such as ARGON 90, cotton, silk, polyester, polypropylene, polyethylene, polytetrafluoroethylene, or any other durable, wind-resistant, water-resistant material known to those with ordinary skill in the art. The first material 216 may be reinforced with a ripstop pattern.

The second material 218, as shown in FIG. 20, is a netting formed of nylon, cotton, silk, polyester, polypropylene, polyethylene, or any other durable netting materials known to those with ordinary skill in the art. The netting of the second material 218 has a hole size sufficient to permit ventilation and visibility while preventing insect penetration such as NO-SEE-UM or NANO NO-SEE-UM netting.

In the embodiment of FIG. 20, the first material 216 forms a majority of cover body 210 while the second material 218 forms a minority of the cover body 210. The second material 218 is disposed at a longitudinal end of the cover body 210. One with ordinary skill in the art would understand that the relative percentages of the first material 216 and second material 218 constituting the cover body 210 may vary depending on the applications of the cover 200. In another embodiment, shown in FIG. 23, the cover body 210 may entirely comprise the second material 218.

The cover body 210, as shown in FIG. 20, has a first side 222 and an opposite second side 224. The first material 216 and the second material 218 constitute the same percentage of each side 222, 224 of the cover body 210.

Figure 22:
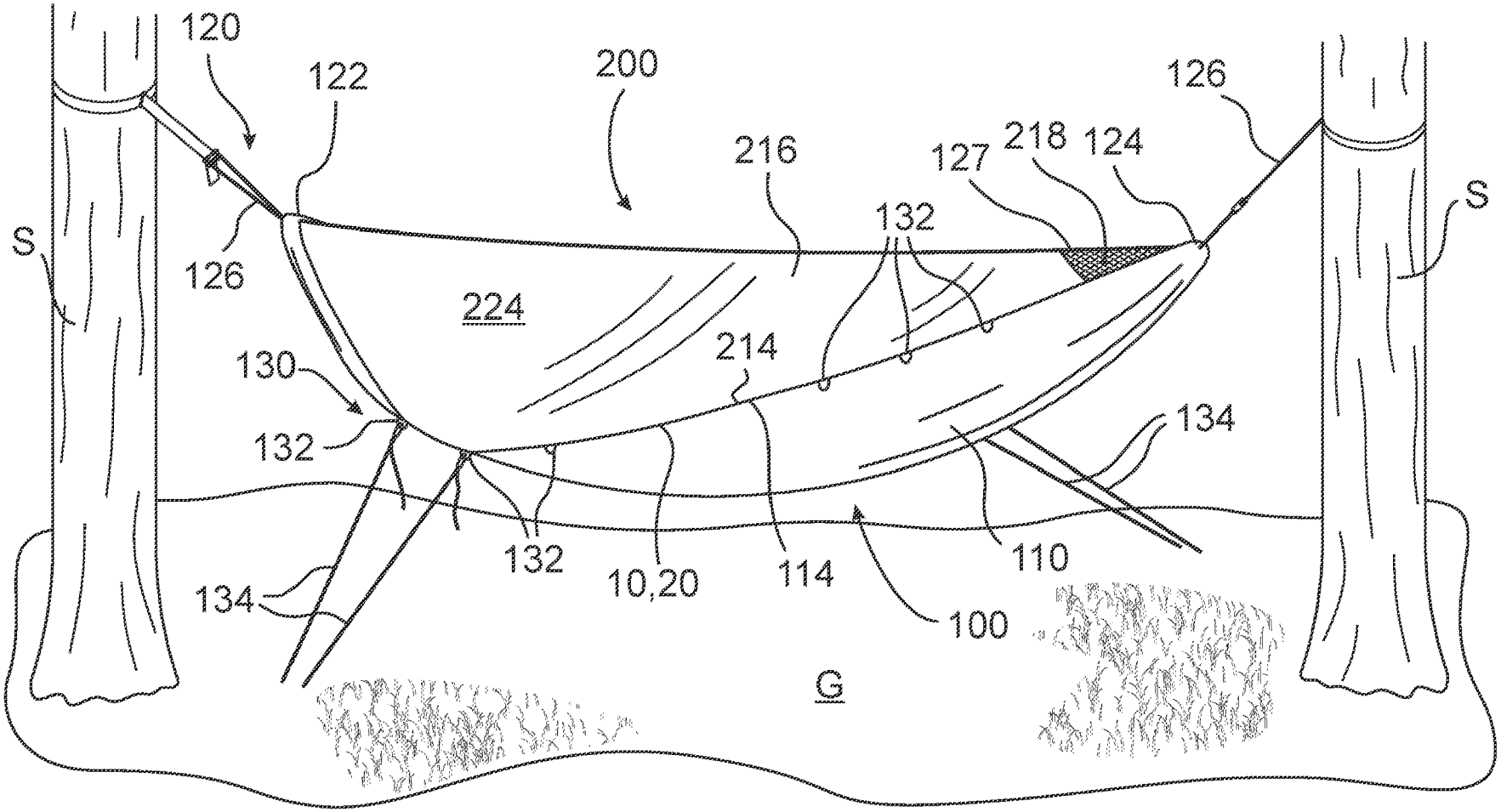
FIG. 22 is a perspective view of the hammock assembly of FIG. 21 in a second orientation.
Figure 23:
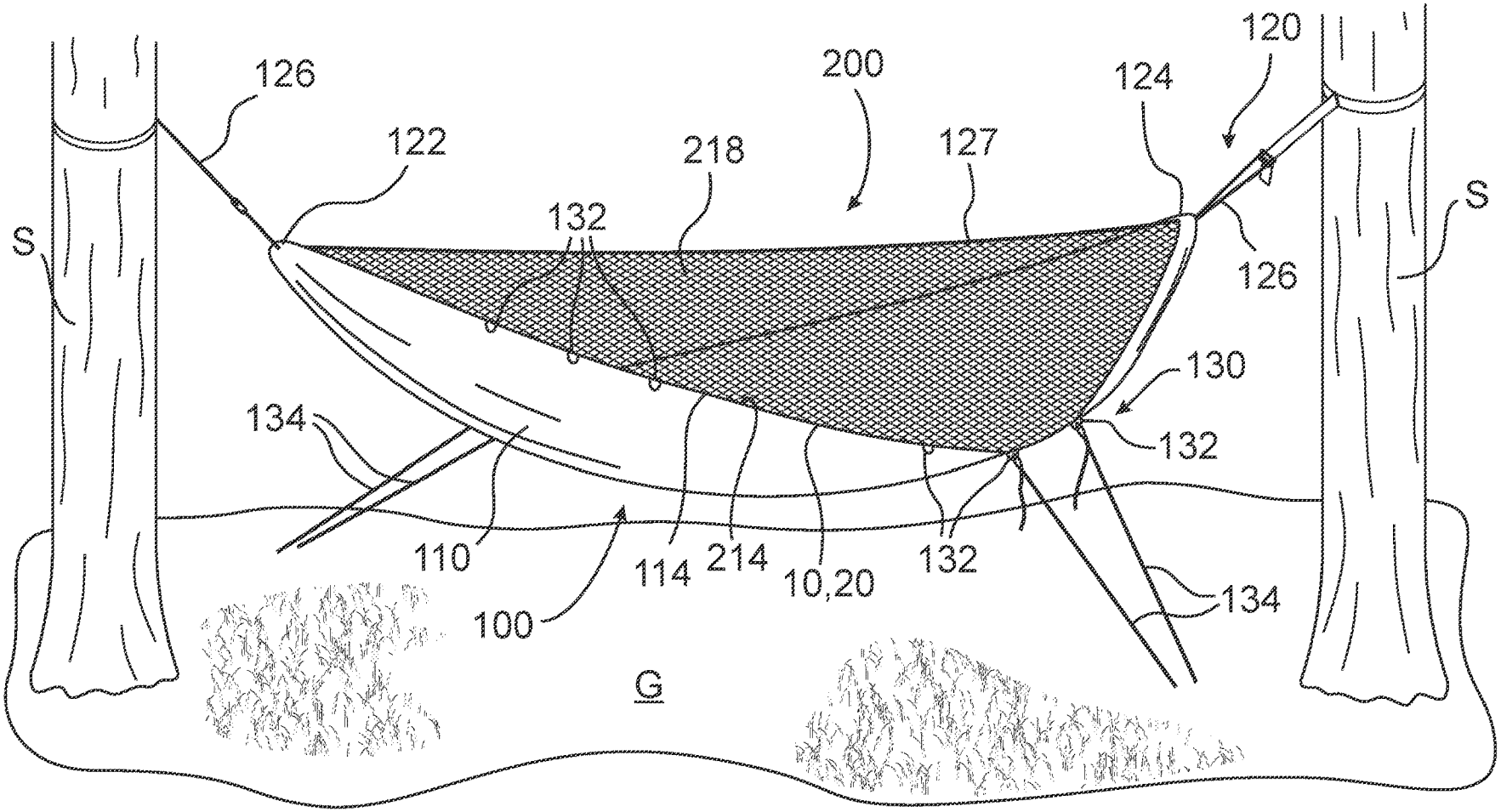
FIG. 23 is a perspective view of a hammock assembly having the hammock of FIG. 14 and another cover according to the invention.

A hammock assembly using the hammock 100 and cover 200 will now be described with reference to FIGS. 21-23.

The cover 200 is removably attached to the hammock 100 when the hammock 100 is in one of the suspended and tensioned positions shown in FIGS. 15-19. The cover 200 is positioned over the hammock 100 such that the shape of the cover body 210 corresponds to the shape of the suspended and tensioned hammock 100. As shown in FIGS. 21-23, the central suspension line 127 supports the cover 200 along the cover longitudinal axis 220 to create an enclosable space between the hammock 100 and the cover 200.

Figure 9:
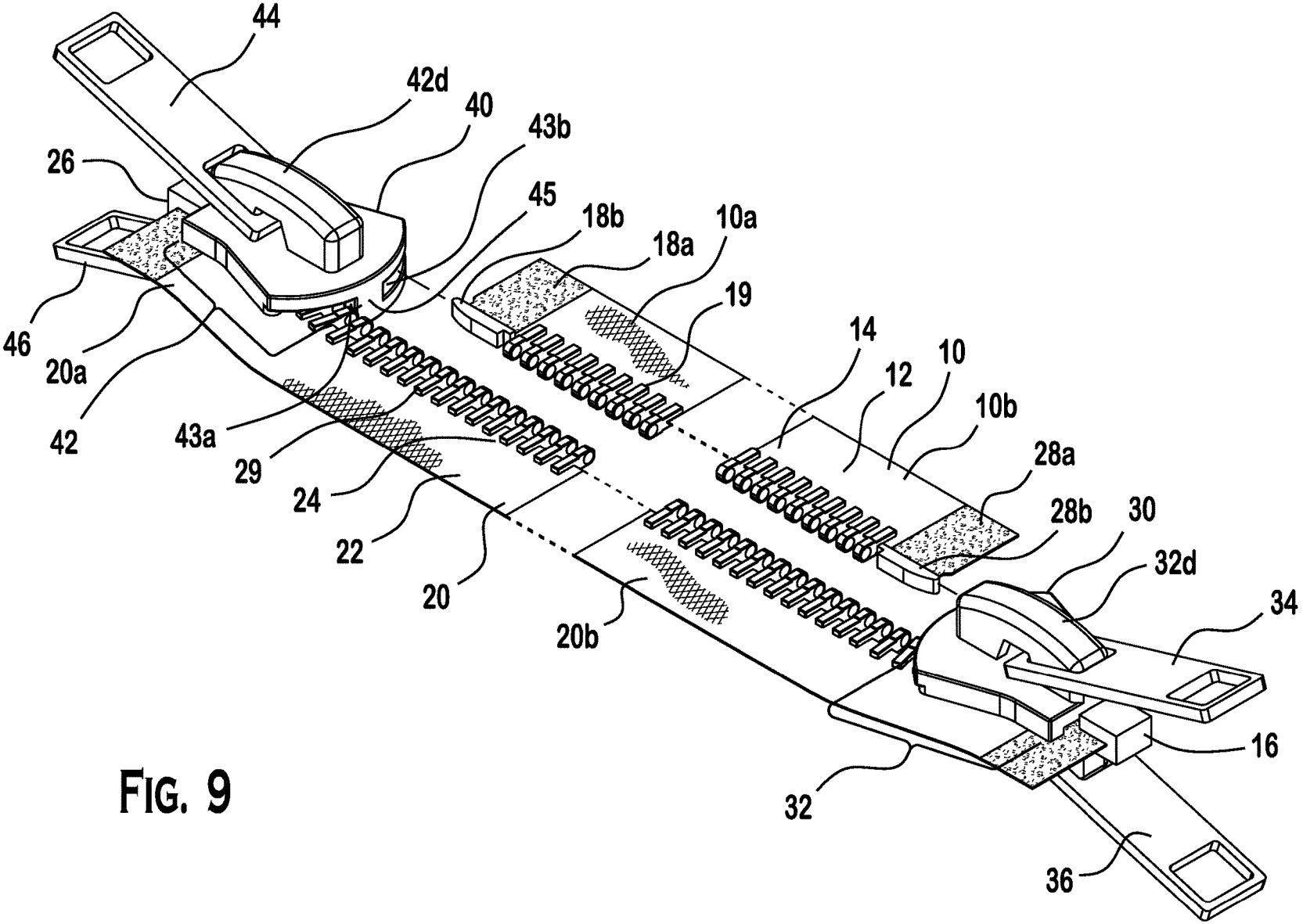
FIG. 9 is a perspective view of another zipper fastener system according to the invention.
Figure 10:
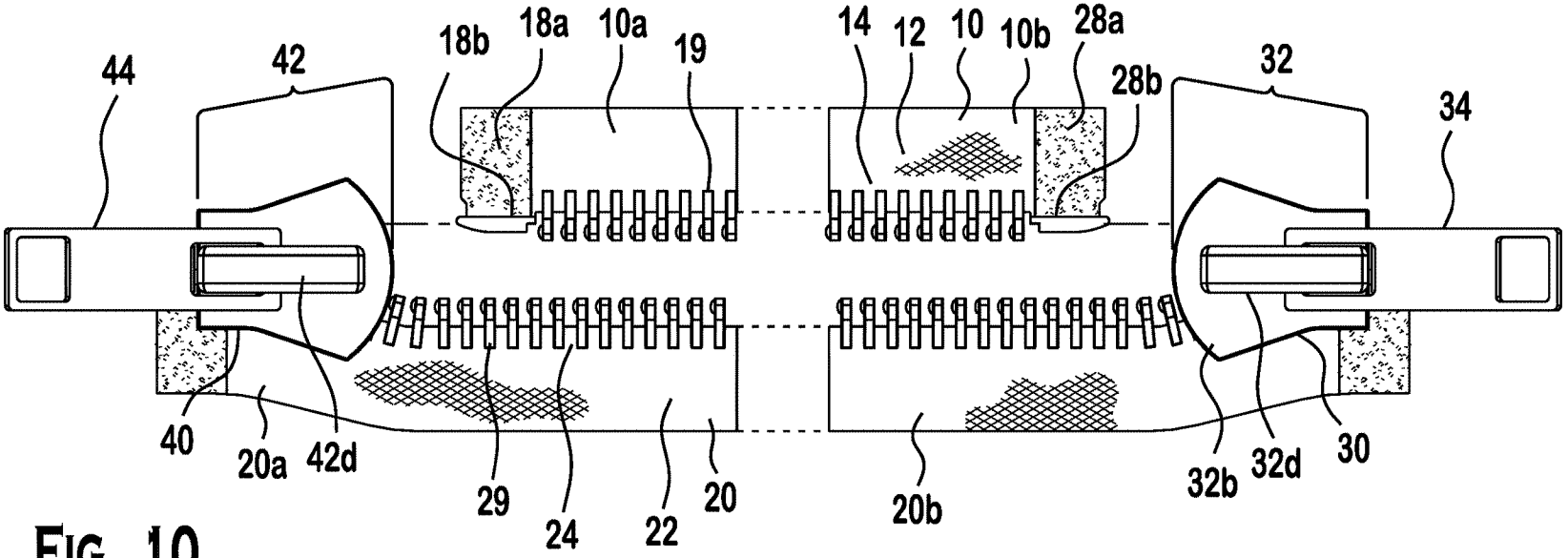
FIG. 10 is a top view of the zipper fastener system of FIG. 9.
Figure 11:
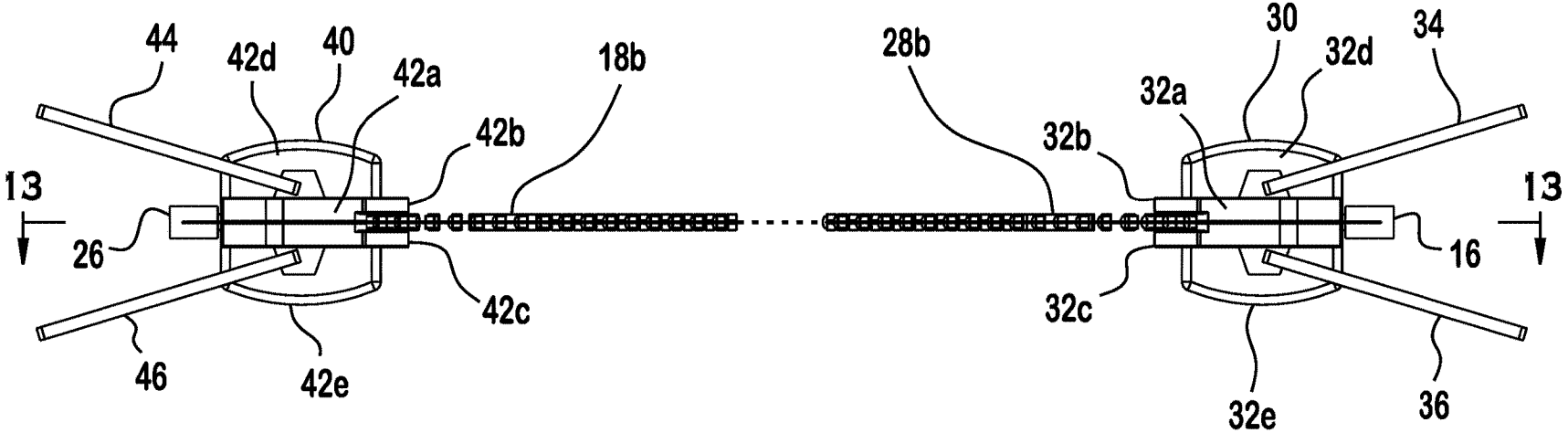
FIG. 11 is a left side view of the zipper fastener system of FIG. 9.
Figure 12:
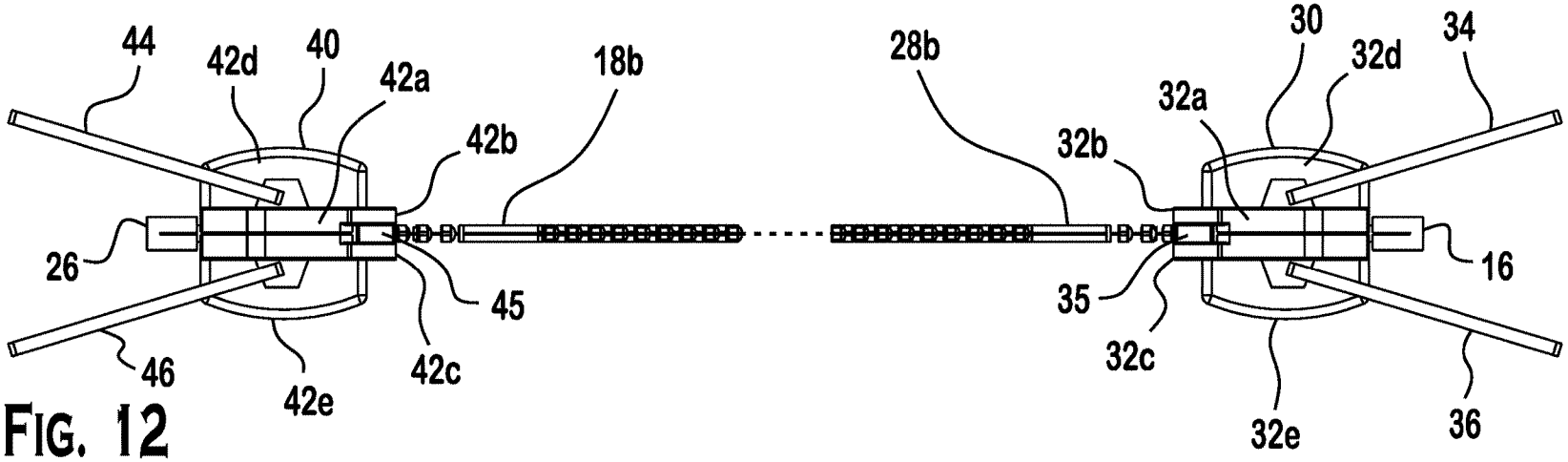
FIG. 12 a right side view of the zipper fastener system of FIG. 9.

The cover 200 is removably attached to the hammock 100 by the zipper fastener system 1. The tape sections 10, 20 disposed on the cover 200 are those which mate with the tape sections 10, 20 disposed on the hammock 100; if first tape sections 10 are disposed on each of the long edges 112, 114 of the hammock 100, then tape sections 20 are disposed on each of the first edge 212 and second edge 214 of the cover 200, and vice versa. Each mating set of tape sections 10, 20 of the zipper fastener system 1 between the hammock 100 and cover 200 has a first slider 30 and a second slider 40. The first slider 20 and second slider 40, as shown in FIGS. 6 and 9, may be disposed on either the same tape section 10, 20 or on different tape sections 10, 20.

The attachment of the cover 200 to the hammock 100 will be described hereinafter with reference to the embodiment of the zipper fastener system 1 shown in FIGS. 1-8, with the first tape section 10 disposed on the first long edge 112 and the second long edge 114 of the hammock 100, and the second tape section 20 disposed on the first edge 212 and the second edge 214 of the cover 200. One with ordinary skill in the art would understand that other configurations of the zipper fastener system 1 described above, such as the embodiment of FIGS. 9-13 or a reversal of the tape sections 10, 20 between the hammock 100 and cover 200, are also possible.

Figure 21:
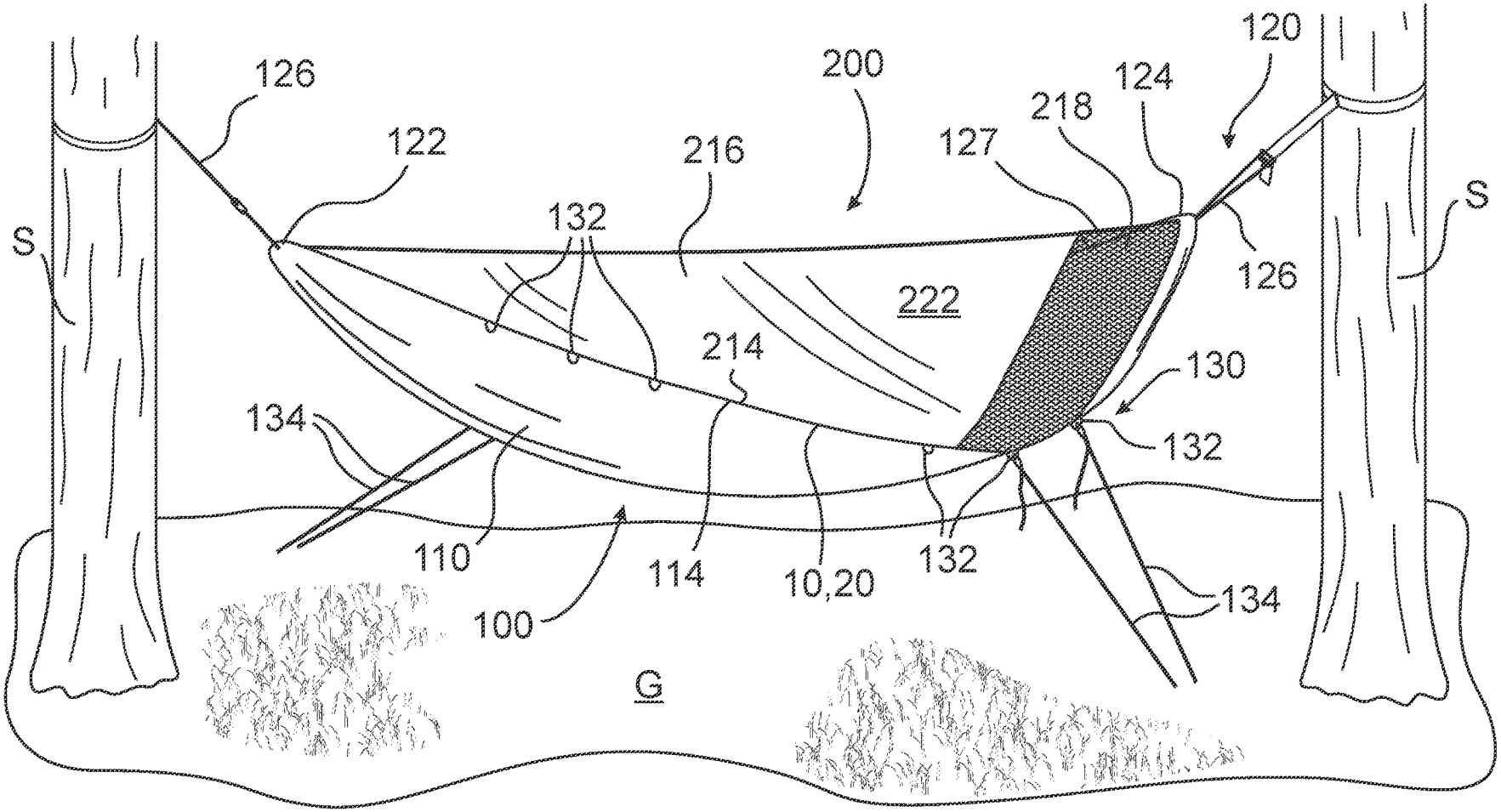
FIG. 21 is a perspective view of a hammock assembly in a first orientation having the hammock of FIG. 14 and the cover of FIG. 20.

As shown in FIG. 21, with the hammock 100 in a first orientation due to the tension system 130, the first side 222 of the cover 200 faces in a vertical direction and the second long edge 114 of the hammock 100 having the first tape section 10 is aligned with the second edge 214 of the cover 200 having the second tape section 20. As shown in detail in FIGS. 1-8, the first slider 30 is movably attached to the first retainer box 16 of the first tape section 10 attached to the hammock 100. The second retainer pin 28*b* of the second tape section 20 attached to the cover 200 is positioned through the first slider 30 and into the first retainer box 16. Likewise, the second slider 40 is movably attached to the second retainer box 26 of the second tape section 20 and the first retainer pin 18*b* of the first tape section 10 is positioned through the second slider 40 and into the second retainer box 26.

The first slider 30 moves along the first tape section 10 of the hammock 100 such that the first set of fastener elements 14 of the first tape section 10 engages and connects with the second set of fastener elements 24 of the second tape section 20 of the cover 200. Likewise, the second slider 40 moves along the second tape section 20 such that the second set of fastener elements 24 engages and connects with the first set of fastener elements 14. Accordingly, the first tape section 10 of the hammock 100 and second tape section 20 of the cover 200 can be connected together and secured, or can be removed and separated from each other, connecting the second long edge 114 of the hammock 100 with the second edge 214 of the cover 200.

Further, with the hammock 100 in the first orientation shown in FIG. 21, the first long edge 112 of the hammock having the first tape section 10 is aligned with the first edge 212 of the cover 200 having the second tape section 20. The removable attachment of the first tape section 10 and second tape section 20, and correspondingly the removable attachment of the first long edge 112 of the hammock 100 with the first edge 212 of the cover 200, is the same as described above with respect to the second long edge 114 of the hammock 100 and the second edge 214 of the cover 200.

The cover 200 is thus removably attached to the hammock 100 by the zipper fastener system 1 connecting two aligned sets of edges 112, 212 and 114, 214. The zipper fastener system 1 used on each set of edges 112, 212 and 114, 214 allows a user to enter and exit the enclosed space between the hammock 100 and cover 200 from either side. The first slider 30 and the second slider 40 meet in the middle of each set of edges 112, 212 and 114, 214 and each have both an outer pull tab 34, 44 and an inner pull tab 36, 46, and consequently, may be used to create variably sized openings and are more easily manipulated by a user from either inside or outside the enclosed space of the hammock 100 and cover 200.

The zipper fastener system 1 also allows other configurations of the hammock 100 and the cover 200. As shown in FIG. 15, because the first tape portions 10 and the second tape portions 20 are separately secured to the hammock 100 and cover 200, the cover 200 is completely removable from the hammock 100. Different embodiments of covers 200 may also be interchangeably attached to the hammock 100. As shown in FIGS. 21 and 22, a cover 200 having the first material 216 and the second material 218 may be attached to the hammock 100. In an exemplary embodiment, the cover 200 shown in FIGS. 21 and 22 is used in cold weather applications as the first material 216 provides wind protection and warmth while the second material 218 constitutes a sufficient percentage of the cover body to permit adequate ventilation for the enclosed space. Alternatively, as shown in FIG. 23, a different embodiment of the cover 200 is interchangeably attached to the hammock 100 in warm weather having only the second material 218 for insect protection.

Figure 2:
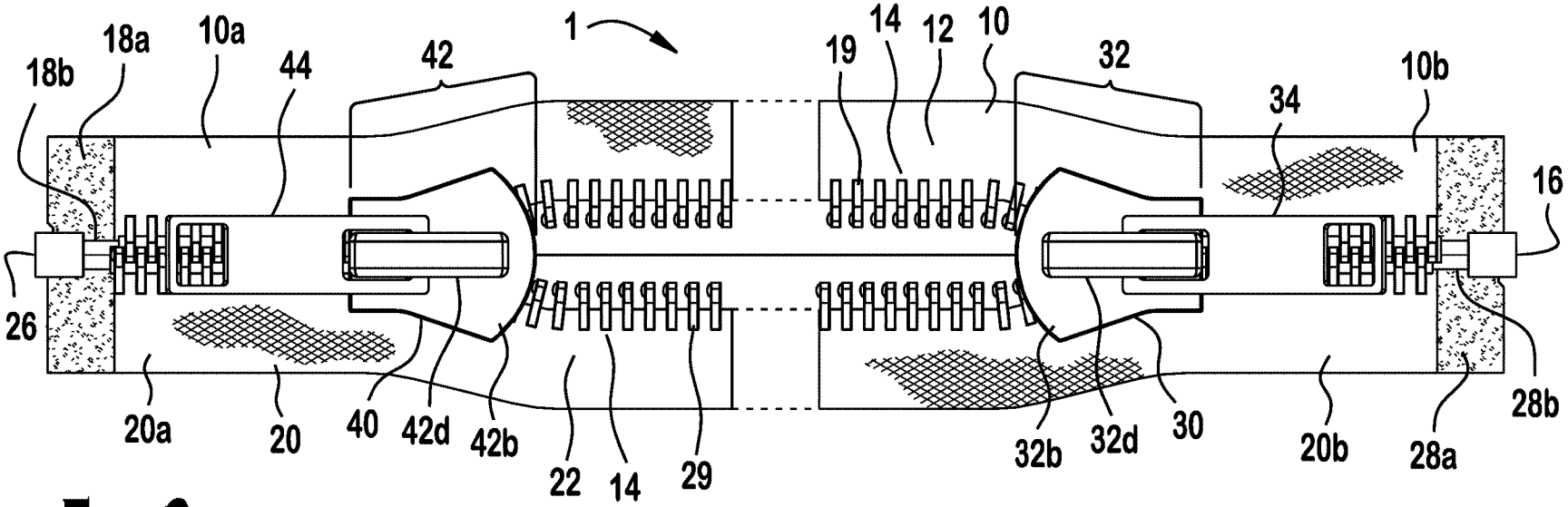
FIG. 2 is a top view of the zipper fastener system of FIG. 1.
Figure 3:
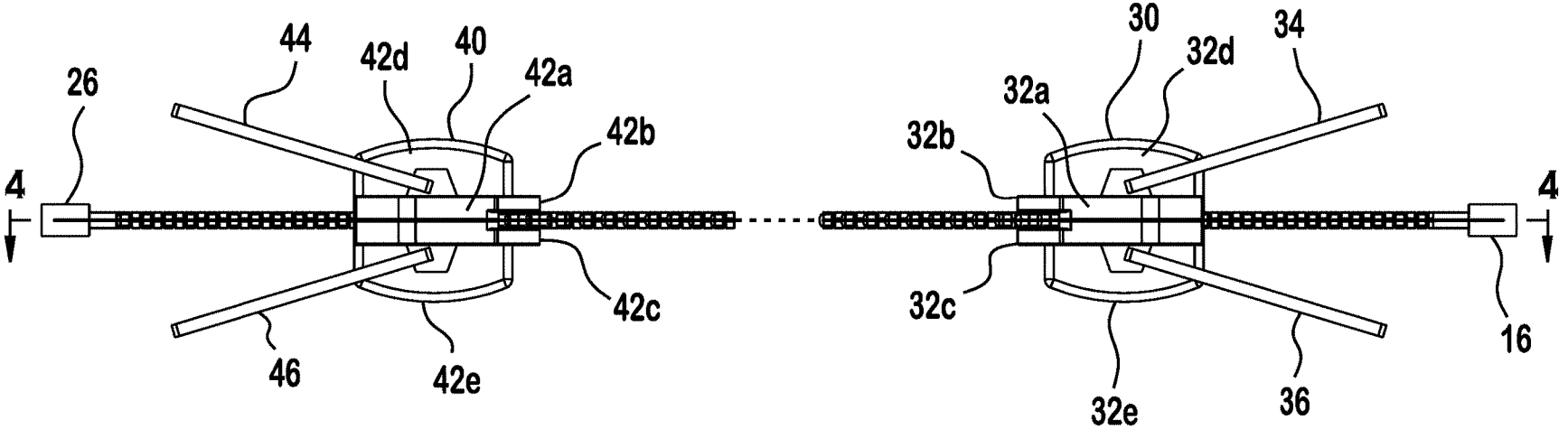
FIG. 3 is a side view of the zipper fastener system of FIG. 1.

The cover 200 is also adaptable to different laying orientations and tension axes 136 of the hammock 100. As shown in FIGS. 16 and 17, the user may lay in either the first position or the second position in the first orientation of the tension axis 136. The cover 200 can be attached to the hammock 100 with the first side 222 facing in the vertical direction as shown in FIG. 2 and the second material 218 at either end of the hammock 100, and consequently, the user can position the ventilating second material 218 over an end at which the user's head is positioned. Further, if the user changes the tension axis 136 from the first orientation shown in FIGS. 16 and 17 to the second orientation shown in FIGS. 18 and 19, the cover 220 is reversible and can be attached at either end of the hammock 100 with the second side 224 facing in the vertical direction, as shown in FIG. 22.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A hammock assembly, comprising:

a fastening system having a first fastening section and a second fastening section corresponding to the first fastening section;

a hammock having a hammock body with the first fastening section attached to an edge thereof, a suspension system forming a suspension axis of the hammock body, and a tension system forming a tension axis of the hammock body that extends at an angle arranged diagonally with respect to the suspension axis, the suspension system includes a central suspension line attaching to a plurality of suspension devices and tensioned along the suspension axis; and a cover removably attachable to the hammock in a plurality of different orientations and having a cover body with the second fastening section attached to an edge thereof, the cover removably attachable to the hammock by connecting the first fastening section to the second fastening section.

2. The hammock assembly of claim 1, wherein the central suspension line supports the cover along a longitudinal axis of the cover to create an enclosable space between the hammock and the cover.

3. The hammock assembly of claim 1, wherein the cover body is formed of a first material and a second material.

4. The hammock assembly of claim 3, wherein the first material is formed of nylon, cotton, silk, polyester, polypropylene, polyethylene, or polytetrafluoroethylene, and the second material is a netting material.

5. The hammock assembly of claim 4, wherein the second material constitutes a sufficient percentage of the cover body to permit adequate ventilation from an enclosed space between the hammock and the cover.

6. The hammock assembly of claim 1, wherein the cover body is formed of only a netting material.

7. A hammock assembly, comprising:

a hammock having:

a hammock body with a first fastening section attached to opposite edges thereof;

a suspension system forming a suspension axis of the hammock body, and a tension system with a plurality of tension connectors disposed on opposite sides of the hammock body and forming a tension axis of the hammock body that extends at an angle arranged diagonally with respect to the suspension axis; and a cover removably attachable to the hammock in a plurality of different orientations and having a cover body with a second fastening section attached to opposite edges thereof, the cover removably attachable to the hammock by connecting the first fastening section to the second fastening section.

8. The hammock assembly of claim 7, wherein the suspension system includes a central suspension line extending between a plurality of suspension devices and tensioned along the suspension axis.

9. The hammock assembly of claim 8, wherein the central suspension line supports the cover along a longitudinal axis of the cover to create an enclosable space between the hammock and the cover.

10. The hammock assembly of claim 7, wherein the cover body is formed of a first material and a second material.

11. The hammock assembly of claim 10, wherein the first material is formed of nylon, cotton, silk, polyester, polypropylene, polyethylene, or polytetrafluoroethylene, and the second material is a netting material.

12. The hammock assembly of claim 11, wherein the second material constitutes a sufficient percentage of the cover body to permit adequate ventilation from an enclosed space between the hammock and the cover.

13. The hammock assembly of claim 7, wherein the cover body is formed of only a netting material.

14. A hammock assembly, comprising:

a zipper fastening system having a first tape section and a second tape section corresponding to the first tape section;

a hammock having a hammock body with the first tape section attached to an edge thereof, a suspension system forming a suspension axis of the hammock body, and a tension system at diagonally opposite ends of the hammock body forming a tension axis of the hammock body that extends at an angle arranged diagonally with respect to the suspension axis, the suspension system includes a central suspension line extending between a plurality of suspension devices and tensioned along the suspension axis; and a cover removably attachable to the hammock in a plurality of different orientations and having a cover body with the second tape section attached to an edge thereof, the cover removably attachable to the hammock by connecting the first tape section to the second tape section.

15. The hammock assembly of claim 14, wherein the hammock body is formed in a rectangular shape.

* * * * *